US006350407B1

(12) United States Patent
Sakata et al.

(10) Patent No.: US 6,350,407 B1
(45) Date of Patent: Feb. 26, 2002

(54) PROCESS FOR PRODUCING SINTERED PRODUCT

(75) Inventors: Masaaki Sakata, Suwa; Kenichi Shimodaira, Kemagame, both of (JP)

(73) Assignee: Injex Corporation, Suwa (JP)

( * ) Notice: Subject to any disclaimer, the term of this patent is extended or adjusted under 35 U.S.C. 154(b) by 0 days.

(21) Appl. No.: 09/446,524

(22) PCT Filed: May 6, 1999

(86) PCT No.: PCT/JP99/02368

§ 371 Date: Dec. 28, 1999

§ 102(e) Date: Dec. 28, 1999

(87) PCT Pub. No.: WO99/56898

PCT Pub. Date: Nov. 11, 1999

(30) Foreign Application Priority Data

May 7, 1998 (JP) ..... 10-125122
May 7, 1998 (JP) ..... 10-125123
May 7, 1998 (JP) ..... 10-125124

(51) Int. Cl.[7] ..... B22F 3/12

(52) U.S. Cl. ..... 419/38; 49/30; 49/36; 49/39; 49/42; 49/55

(58) Field of Search ..... 419/30, 36, 38, 419/39, 42, 55

(56) References Cited

U.S. PATENT DOCUMENTS 5,080,712 A * 1/1992 James et al. ..... 75/229
5,098,648 A * 3/1992 Kiyota et al. ..... 419/23
5,108,492 A * 4/1992 Kiyota et al. ..... 419/56
5,380,476 A * 1/1995 Matsushita et al. ..... 264/63
5,445,788 A * 8/1995 Turenne et al. ..... 419/42

OTHER PUBLICATIONS

R. Erickson et al., "Injection Molding", Metals Handbook, vol. 7, Power Metallurgy, 1984, pp. 495–500.

* cited by examiner

*Primary Examiner*—Ngoclan Mai
(74) *Attorney, Agent, or Firm*—Oliff & Berridge, PLC

(57) ABSTRACT

A method of manufacturing a sintered compact is disclosed herein. The method comprises the steps of: (1A) producing a green body containing metal powder, for example, by means of metal injection molding (MIM); (2A) compacting the green body by pressing it preferably by means of an isostatic pressing (2A); (3A) debinding the compacted green body; and (4A) sintering the debinded green body to obtain a sintered compact. The green body compacting step may be carried out during or after the debinding step or during the debinding step. Further, a step for performing machine working on the green body may be included.

9 Claims, 19 Drawing Sheets

PROCESS FOR PRODUCING SINTERED PRODUCT

FIELD OF THE INVENTION

The present invention relates to a method of manufacturing sintered compacts by sintering metal powder, and more particularly to a manufacturing method in which a green body of a predetermined shape containing a metal powder is prepared, and then the green body is subjected to debinding treatment and sintering treatment to produce sintered compacts.

BACKGROUND ART

As a process of manufacturing a metal product by sintering a green body containing metal powder, there is known in the conventional art a process named as "metal injection molding (MIM)". In MIM, metal powder is mixed with an organic binder and then they are compounded to obtain a compound, and then injection molding is carried out using the compound.

A green body prepared by MIM is subjected to a debinding treatment (binder removal treatment) in order to eliminate the organic binder, and then such green body is sintered.

In order to ensure good forming properties during injection molding, a green body used in MIM must contain an organic binder in a fairly large amount. Therefore, the green body which has undergone the debinding treatment (that is, binder removed green body) tends to have a number of pores. When such a binder removed green body having a number of pores is sintered, the following drawbacks will arise.

(1) While density of the sintered compact is lowered, porosity of the sintered compact is high. This results in a sintered compact with low mechanical strength.

(2) Relatively high sintering temperatures are required. Such high temperatures give a large load to the furnace, thus leading to disadvantages that requires expensive equipment and consumes large amounts of power.

(3) It is impossible to obtain high dimensional precision. For example, when a green body has significant variation its thickness, the obtained sintered compact is likely to have a deformed shape.

It is therefore an object of the present invention to provide a method of manufacturing sintered compacts which can obtain sintered compacts having high density, or can obtain sintered compacts having excellent formability, that is, can obtain sintered compacts having high dimensional precision, and which can moderate sintering conditions such as lowering a sintering temperature to be employed or the like.

SUMMARY OF THE INVENTION

The present invention is directed to a method of manufacturing a sintered compact, which comprises the steps of:

producing a green body containing metal powder;

debinding the green body at least once;

sintering the debinded green body at least once to obtain a sintered compact; and compacting the green body by pressing it, wherein the compacting step is carried out at any time after the green body producing step and prior to a completion of the green body sintering step.

By compacting the green body through the pressing, it becomes possible to increase the density of the final sintered compact and to increase the mechanical strength thereof, as well as to improve dimensional precision of the final sintered compact. Therefore, metal products having high quality can be manufactured.

The green body compacting step may be carried out between the green body producing step and the green body debinding step. In this way, even if molding flaws such as pores would be formed during the production of the green body, such flaws are eliminated to bring the green body in good condition. Therefore, when a sintered compact is formed from the green body through the subsequent debinding treatment and sintering, it is possible to obtain a metal product having especially high qualities based on the sintered compact.

In this case, machine working may be performed on the compacted green body before the completion of the green body sintering step, in particular before the start of the debinding treatment. Since the machine working is performed on the green body which has been compacted by pressing, less variations occur in the shape and dimensions at the working area as compared with the case where such machine working would be performed on an uncompacted green body, and therefore it is possible to improve dimensional precision of the sintered compact. In addition, since the machine working is carried out before the completion of the sintering step, hardness of a work is relatively low as compared with the case where such a machine working would be performed on a sintered compact having a high hardness, so that working can be made easily. Further, since workability is also excellent, the shape and dimensions of the working area can be easily controlled, thus leading to improved dimensional precision.

Further, the green body compacting step may be carried out during the debinding step or between the debinding step and the green body sintering step. In this way, it becomes possible to reduce the number of pores present in the green body and thereby to increase its density prior to sintering. This makes it possible to obtain a sintered compact having high density and high mechanical strength as well as to moderate sintering conditions such as lowered sintering temperature, shortened sintering time and the like, thus leading to improved sinterability and reduced load to a sintering furnace and the like.

In this case, machine working may be performed on the compacted green body before the completion of the green body sintering step, in particular before the completion of the debinding treatment or the start of the sintering step. Since the machine working is performed on the green body which has been compacted by pressing, less variations occur in the shape and dimensions at the working area as compared with the case where such machine working would be performed on an uncompacted green body, and therefore it is possible to improve dimensional precision of the sintered compact. In addition, since the machine working is carried out before the completion of the sintering step, hardness of a work is relatively low as compared with the case where such a machine working would be performed on a sintered compact having a high hardness, so that working can be made easily. Further, since workability is also excellent, the shape and dimensions of the working area can be easily controlled, thus leading to improved dimensional precision.

Further, the green body compacting step may be carried out during the green body sintering step. In this way, it is possible to reduce pores present in the green body (presintered compact" during the sintering process to increase its density, thus enabling to obtain a sintered compact having higher density and higher mechanical strength. Further, it is also possible to moderate sintering conditions such as lowered sintering temperature, shortened sintering time and the like, thus leading to improved sinterability and reduced load to a sintering furnace and the like.

In this case, machine working may be performed on the compacted green body before the completion of the green body sintering step. Since the machine working is performed on the green body (presintered compact) which has been compacted by pressing, less variations occur in the shape and dimensions at the working area as compared with the case where such machine working would be performed on an uncompacted green body (debinded green body or presintered compact), and therefore it is possible to improve dimensional precision of the sintered compact. In addition, since the machine working is carried out before the completion of the sintering step, hardness of a work is relatively low as compared with the case where such a machine working would be performed on a sintered compact having a high hardness, so that working can be made easily. Further, since workability is also excellent, the shape and dimensions of the working area can be easily controlled, thus leading to improved dimensional precision.

Further, in the present invention, it is preferred that the pressing for compaction is carried out isotropically, in particular the pressing for compacting is carried out by means of an isostatic pressing. In this way, it becomes possible to produce a green body and a sintered compact having uniform density with a simple method.

In this case, it is preferred that the isostatic pressing is carried out at ambient temperature or temperature close thereto, because equipment for pressing can be simplified and no heat resistance property is required to waterproof coating film.

In the present invention, it is preferred that the pressing is 1 to 100 t/cm$^2$. This makes it possible to achieve sufficient compaction without requiring large-scale pressing equipment.

Furthermore, in the present invention, it is preferred that the green body producing step is carried out by means of metal injection molding. This makes it possible to manufacture metal sintered products having a relatively small size and/or a complex and intricate shape, and having relatively high mechanical strength.

Moreover, in the present invention, it is also preferred that the metal powder content of the green body Just before the debinding treatment is 70 to 98 wt %. When using such a green body, it becomes possible to ensure good formability when the green body is produced, and to prevent shrinkage from being increased during sintering of the green body.

In the present invention, it is also preferred that the metal powder for the green body is prepared in accordance with a gas atomization method. Particles of meal powder produced by the gas atomization method have a roughly spherical shape, so that it is possible to moderate a particle size of metal powder and pressing conditions. With this result, it becomes possible to enhance the mechanical strength of the obtained sintered compact.

Another aspect of the present invention is directed to a method of manufacturing a sintered compact, which comprises the steps of:

producing a green body containing metal powder;

compacting the green body by pressing it;

debinding the compacted green body at least once; and sintering the debinded green body at least once to obtain a sintered compact.

Provision of the step for compacting the green body by pressing it makes it possible to increase the density of the final sintered compact and to increase the mechanical strength thereof, as well as to improve dimensional precision of the final sintered compact. Therefore, metal products having high quality can be manufactured. In particular, even if molding flaws such as pores would be formed during the production of the green body, such flaws are eliminated by pressing the green body to bring the green body in good condition. Therefore, when a sintered compact is formed from the green body through the subsequent debinding treatment and sintering, it is possible to obtain a metal product having especially high qualities based on the sintered compacts.

In this case, machine working may be performed on the green body between the green body compacting step and the debinding step. Since the machine working is performed on the green body which has been compacted by pressing, less variations occur in the shape and dimensions at the working area as compared with the case where such machine working would be performed on an uncompacted green body, and therefore it is possible to improve dimensional precision of the sintered compact. In addition, since the machine working is performed on the green body of which hardness is greatly lower than that of the high hardness sintered compact, working can be made easily. Further, since workability is also excellent, the shape and dimensions of the working area can be easily controlled, thus leading to improved dimensional precision.

Other aspect of the present invention is directed to a method of manufacturing a sintered compact, which comprises the steps of:

producing a green body containing metal powder;

conducting a first debinding treatment on the green body;

compacting the debinded green body by pressing it;

conducting a second debinding treatment on the compacted green body; and sintering the debinded green body at least once to obtain a sintered compact.

Provision of the step for compacting the green body by pressing it makes it possible to increase the density of the final sintered compact and to increase the mechanical strength thereof, as well as to improve dimensional precision of the final sintered compact. Therefore, metal products having high quality can be manufactured. In particular, it is possible to reduce the number of pores present in the green body and thereby to increase its density prior to sintering. This makes it possible to obtain a sintered compact having high density and high mechanical strength as well as to moderate sintering conditions such as lowered sintering temperature, shortened sintering time and the like, thus leading to improved sinterability and reduced load to a sintering furnace and the like.

In this case, machine working may be performed on the green body between the green body compacting step and the step for conducing the second debinding treatment. Since the machine working is performed on the green body which has been compacted by pressing, less variations occur in the shape and dimensions at the working area as compared with the case where such machine working would be performed on an uncompacted green body, and therefore it is possible to improve dimensional precision of the sintered compact. In addition, since the machine working is carried out before the completion of the sintering step, hardness of a work is relatively low as compared with the case where such a machine working would be performed on a sintered compact having a high hardness, so that working can be made easily. Further, since workability is also excellent, the shape and dimensions of the working area can be easily controlled, thus leading to improved dimensional precision.

The other aspect of the present invention is directed to a method of manufacturing a sintered compact, which comprises the steps of:

producing a green body containing metal powder;

debinding the green body at least once;

presintering the debinded green body;

compacting the presintered green body by pressing it; and sintering the compacted presintered green body further to obtain a sintered compact.

Provision of the step for compacting the green body by pressing it makes it possible to reduce pores present in the presintered compact and to increase the density thereof, thus enabling to obtain a sintered compact having a higher density and a higher mechanical strength. Further, this also makes it possible to moderate sintering conditions such as lowered sintering temperature, shortened sintering time and the like, thus leading to improved sinterability and reduced load to a sintering furnace and the like.

In this case, machine working may be performed on the compacted presintered green body between the presintered green body compacting step and the presintered green body sintering step. Since the machine working is performed on the presintered compact which has been compacted by pressing it, less variations occur in the shape and dimensions at the working area as compared with the case where such machine working would be performed on an uncompacted green body (debinded green body or presintered compact), and therefore it is possible to improve dimensional precision of the sintered compact. In addition, since the machine working is carried out before the completion of the sintering step, that is prior to the main sintering process, hardness of a work is relatively low as compared with the case where such a machine working would be performed on a final sintered compact having high hardness, so that working can be made easily. Further, since workability is also excellent, the shape and dimensions of the working area can be easily controlled, thus leading to improved dimensional precision.

In this case, it is preferred that the green body presintering step is being carried out until diffusion bonding is made at least at contact points of particles of the metal powder. Conducting presintering in this way increases the shape stability. As a result, it becomes possible to reliably prevent various flaws of the green body (presintered compact) such as breaking, chipping, cracking and the like from occurring during the subsequent compacting step and the machine working process, thus improving handling ability thereof.

PREFERRED EMBODIMENTS OF THE INVENTION

Hereinafter, a method of manufacturing sintered compacts according to the present invention is described in detail with reference to the accompanying drawings.

FIRST EMBODIMENT

Figure 1:
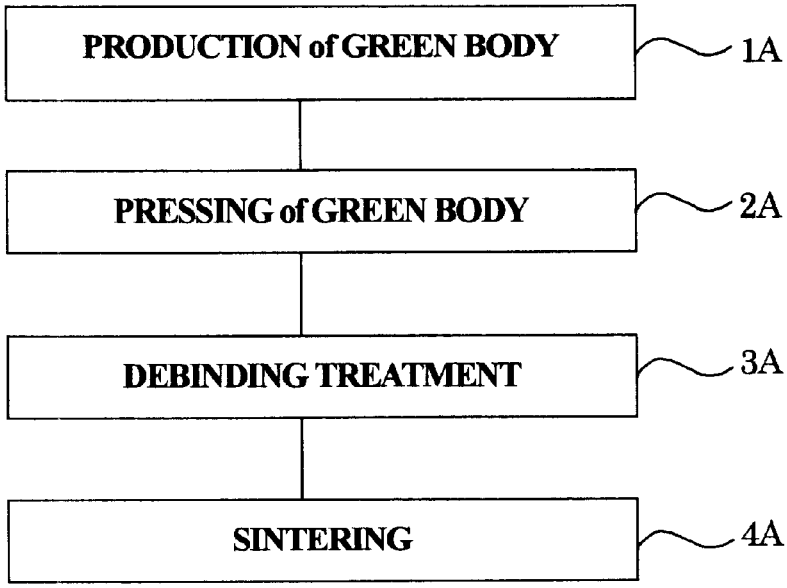
FIG. 1 is a step diagram which shows the first embodiment of a method of manufacturing sintered compacts according to the present invention.

FIG. 1 is a step diagram which shows a first embodiment of the sintered compact manufacturing method according to the present invention; and FIGS. 3 to 6 are illustrations which respectively show a sectional structure (internal metallographic structure) of a green body (or sintered compact) at each step. Hereinafter, with reference to the drawings, the first embodiment of the sintered compact manufacturing method will be described.

[1A] Production of Green Body

A method for producing a green body is not limited to any particular method, and a typical powder compacting process may be used. In this invention, however, metal injection molding (MIM) is preferably used.

Metal injection molding has the advantages of being able to produce sintered metal products that are relatively small in size and that have complex and intricate shapes, and to give high mechanical strength thereto. Therefore, MIM is particularly preferred in this invention, because these advantages can be effectively realized in practicing the present invention.

Production of a green body by MIM is described below.

First, a metal powder and a binder (organic binder) are prepared, and then they are compounded by a compounding machine to obtain a compound.

No limitation is imposed upon the metal material for the metal powder (hereinbelow, referred to simply as "metal material"). For example, at least one of Fe, Ni, Co, Cr, Mn, Zn, Pt, Au, Ag, Cu, Pd, Al, W, Ti, V, Mo, Nb, Zr, Pr, Nd, Sm and the like; or alloys (mainly) containing at least one of these elements may be used as a constituent material for the metal powder.

According to the present invention, the formability of the sintered compact can be improved as described above. Therefore, as for metal materials for the sintered compact, it is preferable (possible) to use any metal material by which a finally obtained sintered body can have a relatively high hardness or be difficult to process. Specific examples of such metal materials include Fe-base alloys such as stainless steels (e.g., SUS 304, SUS 316, SUS 317, SUS 329J1, SUS 410, SUS 430, SUS 440 and SUS 630), die steel, high speed tool steel and the like; Ti or Ti-base alloys; W or W-base alloys; Co-base cemented carbides; Ni-base cermets; and the like.

No limitation is imposed upon mean particle size of metal powder, but it is preferably smaller than 50 $\mu$m, and more preferably about 0.1 to 40 $\mu$m. Excessively large mean particle size can result in low density of the sintered compact, depending on other factors.

Further, no limitation is imposed upon the method for producing the metal powder. For example, a water atomization method, a gas atomization method, a reduction method, a carbonyl method, or a comminution method may be used to produce the metal powder.

Examples of the binder include polyolefines such as polyethylene, polypropylene, ethylene-vinyl acetate copolymer and the like; acrylic resins such as polymethyl methacrylate, polybutyl methacrylate and the like; styrene resins such as polystyrene and the like; various resins such as polyvinyl chloride, polyvinylidene chloride, polyamide, polyester, polyether, polyvinyl alcohol, copolymers of the above and the like; various waxes; paraffin; higher fatty acids (e.g., stearic acid); higher alcohols; higher fatty acid esters; higher fatty acid amides; and the like. These may be used singly or in combinations of two or more.

Plasticizers may also be added. Examples of the plasticizers include phthalic acid esters (e.g., DOP, DEP and DBP), adipic acid esters, trimellitic acid esters, sebacic acid esters and the like. These may be used singly or in combinations of two or more.

In addition to the metal powder, binder and plasticizers, if required, various additives such as lubricants, antioxidants, debinding promoters, surface active agents and the like may be added during the compounding process.

Conditions for compounding will vary depending on the component and particle size of the metal powder to be used, and the type and amount of the binder and additives to be added. An example of conditions is a compounding temperature of 20 to 200° C. and a compounding time of about 20 to 210 minutes. The obtained feed stock may be pelletized if necessary. Pellet size is set within the range of approximately 1 to 10 mm, for example.

The feed stock prepared in the above-mentioned manner, or the pellets produced from the prepared feed stock is subjected to injection molding with an injection molding machine to produce a green body having a desired shape and dimensions. In this case, a green body having complex and intricate shape can be produced easily by selectively using a suitable die.

The shape and dimensions of the green body to be produced should be decided upon taking into account the estimated shrinkage that the green body will experience during debinding and sintering treatment.

Conditions for injection molding will vary depending on the component and particle size of the metal powder to be used, the type and amount of the binder, and other factors. As an example of conditions, the material temperature is preferably about 20 to 200° C. and the injection pressure is preferably about 30 to 150 kgf/cm$^2$.

Figure 3:
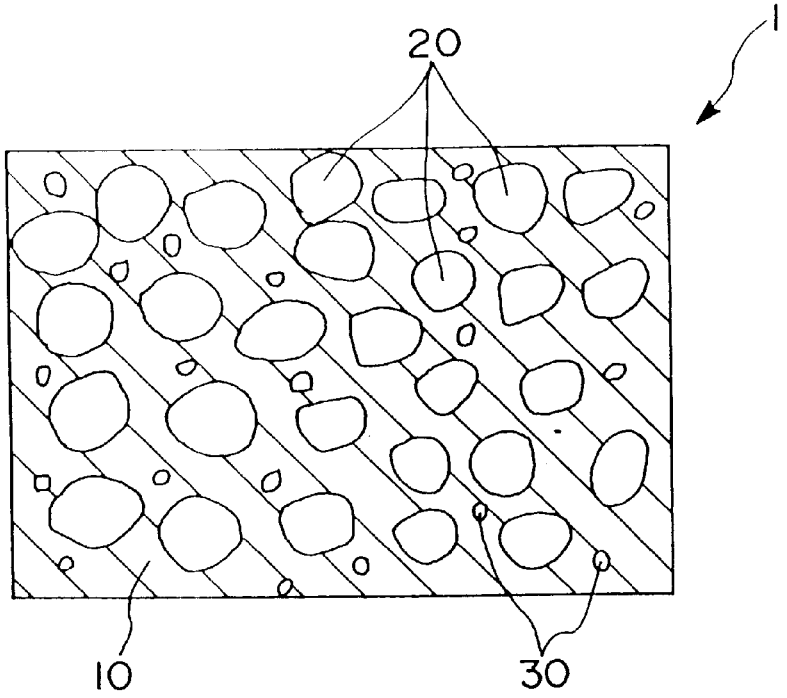
FIG. 3 is an illustration which shows a sectional structure (internal metallographic structure) of a green body at a step of producing the green body.

FIG. 3 shows the sectional structure of the green body 1 produced in this manner. As shown in this figure, the metal powder 20 and pores 30 are substantially uniformly distributed throughout the binder 10.

[2A] Pressing of Green Body

Pressure is applied to the green body produced in the above-mentioned manner to effect compaction thereof.

The pressing method is not limited into any particular way. Examples of pressing methods include a method in which the green body is pressed in a predetermined direction, such as rolling or pressing; and a method in which the green body is pressurized isotropically, such as isostatic pressing. The latter method, particularly isostatic pressing, is preferred. Hereinafter, a description will be made with regard to the isostatic pressing.

The isostatic pressing method includes cold isostatic pressing (CIP) which performs pressing at ambient temperature or temperature close to ambient temperature (5 to 60° C., for example); and hot isostatic pressing (HIP) which performs pressing under heating condition (80° C. or above, for example). The former is preferred due to the simplicity of the equipment required. Further, since it is not necessary for a coating film to have heat resistance as described later, the former is especially preferred in the case where a green body having three-dimensional shape or having complex and intricate shape is used.

In the isostatic pressing, first, the surface of the green body is covered with a coating film having liquid barrier properties (not shown in the drawings), and then the green body is placed in a isostatic pressing unit, where it is subjected to isostatic pressing. In the case of CIP, rubber material such as natural rubber, isoprene rubber and the like may be used for the coating film. Further, the coating film may be formed, for example, by dipping.

No limitations are imposed upon the pressure employed in this isostatic pressing (isotropic pressing). In preferred practice, the pressure is about 1 to 100 t/cm$^2$, and more preferably about 3 to 80 t/cm$^2$. Excessively low pressure may not give adequate effect (that is, reduction in porosity through compaction). On the other hand, if pressure is higher than the upper limit given above, it is impossible to achieve an improved effect. In addition, a pressure exceeding the upper limit given above has the drawback of requiring a larger machine, resulting in higher equipment costs.

Figure 4:
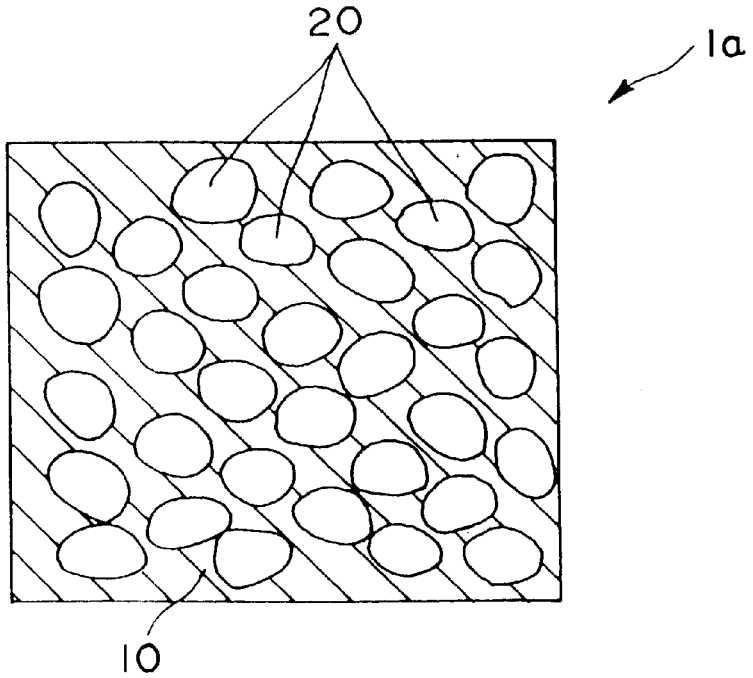
FIG. 4 is an illustration which shows a sectional structure (internal metallographic structure) of a green body after pressing.

After pressing, the green body 1*a* produced in the above-mentioned manner will be in good condition, with molding flaws having been corrected. The sectional structure of the green body 1*a* after pressing is shown in FIG. 4. As shown in this figure, air present in pores 30 has been expelled and eliminated or reduced in amount due to the pressing, resulting in higher density. Further, in the green body after pressing, the metal powder 20 is substantially uniformly dispersed in the binder, since dispersion of the metal powder 20 is improved during the pressing.

In this case, the content of the metal powder in the green body 1*a* after the pressing and prior to the debinding treatment is preferably about 70 to 98 wt %, and more preferably about 82 to 98 wt %. When the content of the metal powder is lower than 70 wt %, the green body 1*a* experiences greater shrinkage with sintering, and therefore dimensional precision is deteriorated. Further, the porosity and C content of the sintered compact tends to increase. On the other hand, when the content of the metal powder exceeds 98 wt %, the relative content of the binder 10 becomes too small, resulting in poor fluidity during injection molding. This makes injection molding difficult or impossible, or results in inhomogeneous green body composition.

After the pressing, the coating film on the surface of the green body 1*a* may be peeled and removed. Typically, however, there is no need to provide separately a step of removing the coating film, since it can be eliminated by heat in the course of the subsequent debinding or sintering treatment.

[3A] Debinding Process for Debinding Green Body

The green body after the pressing produced in the step [2A] is then subjected to a debinding treatment (binder removing treatment).

Debinding is effected by heat treatment under a non-oxidizing atmosphere such as under a vacuum or reduced pressure state ($1\times10^{-1}$ to $1\times10^{-6}$ torr, for example), or under an inert gas such as nitrogen gas, argon gas and the like.

In this case, conditions for heat treatment are preferably about 0.5 to 40 hours at a temperature of about 150 to 750° C., and more preferably about 1 to 24 hours at a temperature of about 250 to 650° C.

Depending on a particular objective (for example, shorter debinding time) the debinding process by the heat treatment may be conducted in multiple steps (stages). In this case, examples include a debinding method in which the initial part is carried out at low temperature and the latter part is carried out at high temperature, and a method in which low temperature and high temperature are repeated alternately. In this connection, the debinding treatment may be brought to completion through the same manner as in steps [2D] and [4D] (described later).

The debinding treatment may be accomplished by eluting predetermined components from the binder or additives with the aid of predetermined solvent (liquids, gases).

Figure 5:
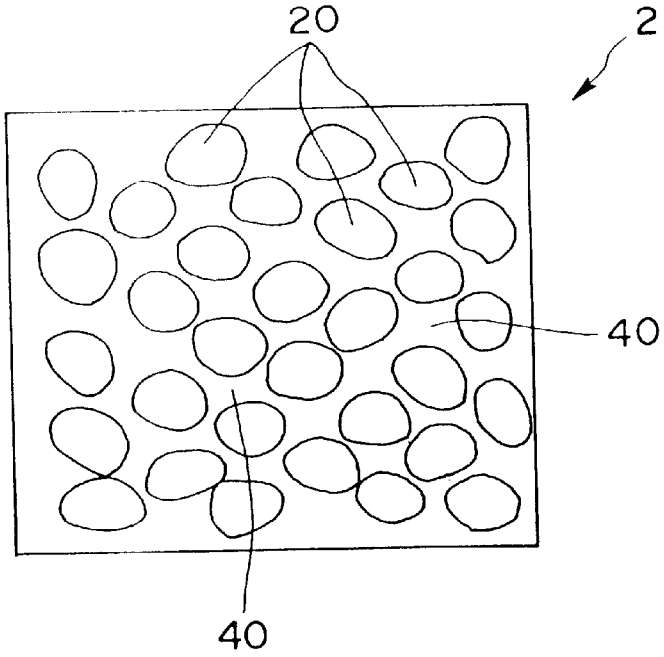
FIG. 5 is an illustration which shows a sectional structure (internal metallographic structure) of a green body (binder removed green body) after debinding treatment.

The sectional structure of the debinded green body (brown body) 2 produced in this manner is shown in FIG. 5, in which pores 40 have formed where the binder 10 was formerly present.

[4A] Sintering of Green Body

The green body (debinded green body 2) produced in the above-mentioned manner is then sintered in a sintering furnace to produced a metal sintered compact.

Figure 6:
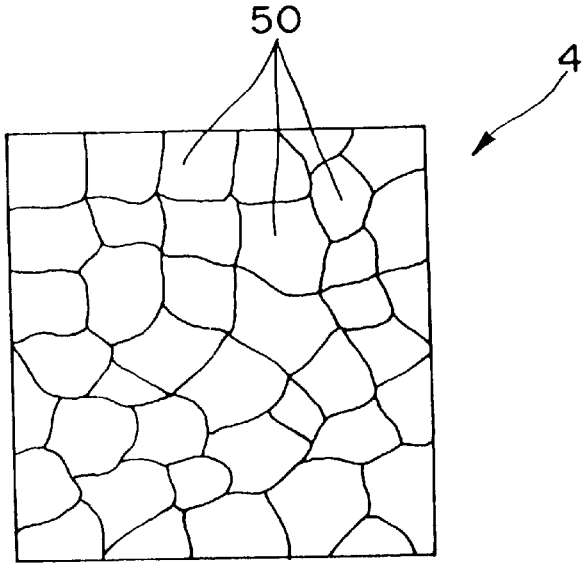
FIG. 6 is an illustration which shows a sectional structure (internal metallographic structure) of a sintered compact.

Diffusion and grain growth of the metal powder 20 are promoted by sintering, and thus grains 50 as shown in FIG. 6 are created. During the sintering, the pores 40 disappear to form a sintered compact 4 which is dense overall, that is, a sintered compact having high density and low porosity.

In the case where the metal composition is, for example, Fe or Fe-base alloy, the sintering temperature during sintering is preferably about 950 to 1400° C., and more preferably about 1100 to 1350° C. Further, in the case where the metal composition is Ti or a Ti-base alloy, the sintering temperature is preferably about 900 to 1350° C., and more preferably about 1000 to 1300° C. Furthermore, in the case where the metal composition is W or W-base alloy, it is preferably about 1100 to 1600° C., and more preferably about 1200 to 1500° C.

Higher sintering temperatures are advantageous since they can shorten sintering time. on the other hand, however, if sintering temperature is too high, a large load is given to the sintering furnace and sintering jig, so that the life span thereof is shortened due to wear and the like. However, in the present invention, the provision of the step [2A] makes it possible that internal stress created by pressing is released so that diffusion of the metal occurs at lower temperatures, which is advantageous in that sintering temperatures can be lowered and sintering time can be shortened. Such lower sintering temperatures contribute to improve sinterability, as a result facilitating sintering of metal compositions which were difficult to alloy in the past.

In this connection, it is to be noted that the sintering temperature may be changed (risen or lowered) with elapse of time within or outside of the range mentioned in the above, if desired.

In the case where the sintering temperatures given in the above are employed, sintering time is preferably about 0.5 to 8 hours and more preferably about 1 to 5 hours.

In preferred practice, the sintering atmosphere is a non-oxidizing atmosphere that does not contain hydrogen. This improves safety in sintering, and contributes to reduced porosity in the sintered compact.

The preferred sintering atmosphere is one under a reduced pressure (a vacuum) of $1\times10^{-2}$ torr or lower (more preferably $1\times10^{-2}$ to $1\times10^{-6}$ torr), or under an inert gas such as nitrogen gas, argon gas and the like at 1 to 760 torr.

The sintering atmosphere can be changed during the sintering. For example, the sintering atmosphere, which has been initially set to a reduced pressure (a vacuum) of $1\times10^{-2}$ to $1\times10^{-6}$ torr, may be changed into the atmosphere under the inert gases mentioned in the above during the sintering.

Conducting sintering under the conditions described above contributes to reduced porosity, that is, higher density of the sintered compact, and enables to obtain high dimensional precision. Further, the conditions also enable to carry out sintering treatment effectively, which results in a shorter sintering time, and realize to a high safety in sintering operation, thereby making it possible to improve productivity in manufacturing sintering compacts.

Alternatively, sintering may be carried out in two or more stages. For example, sintering process may involve first sintering stage and second sintering stage which are conducted under sintering conditions different from those of the first sintering state. In this case, the sintering temperature for second sintering stage may be set to a higher temperature than that for the first sintering stage. In this way, it becomes possible to further improve sintering efficiency and to further reduce porosity.

The first sintering stage and second sintering stage referred to herein may be carried out in the same manner as in steps [3G] and [5G] (described later), respectively.

Depending on a particular objective, the present invention may include a preliminary step coming before the step [1A], an intermediate step coming between the steps [1A] and [4A], or a post step coming after the step [4A].

SECOND EMBODIMENT

Figure 2:
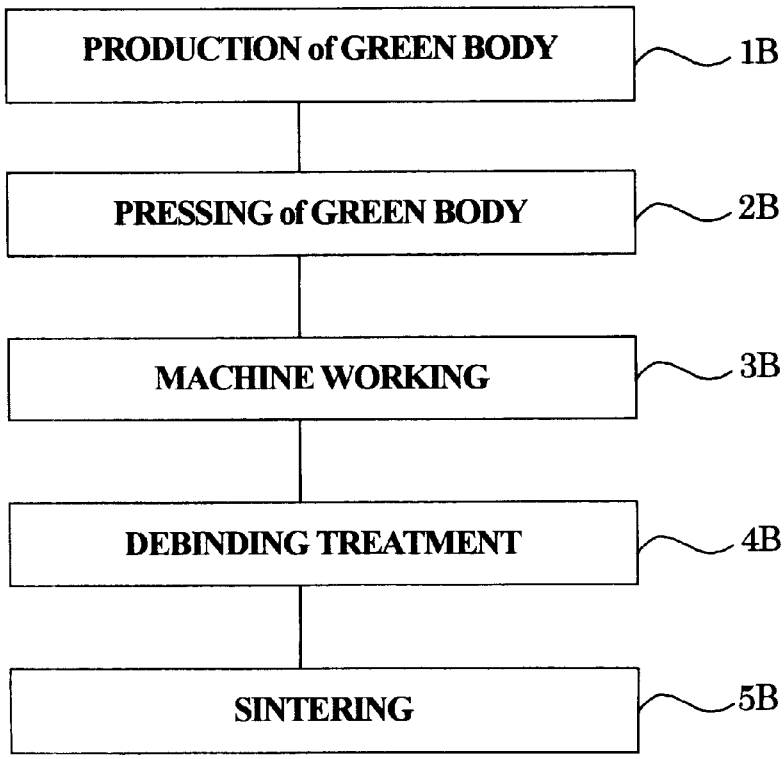
FIG. 2 is a step diagram which shows the second embodiment of a method of manufacturing sintered compacts according to the present invention.
Figure 7:
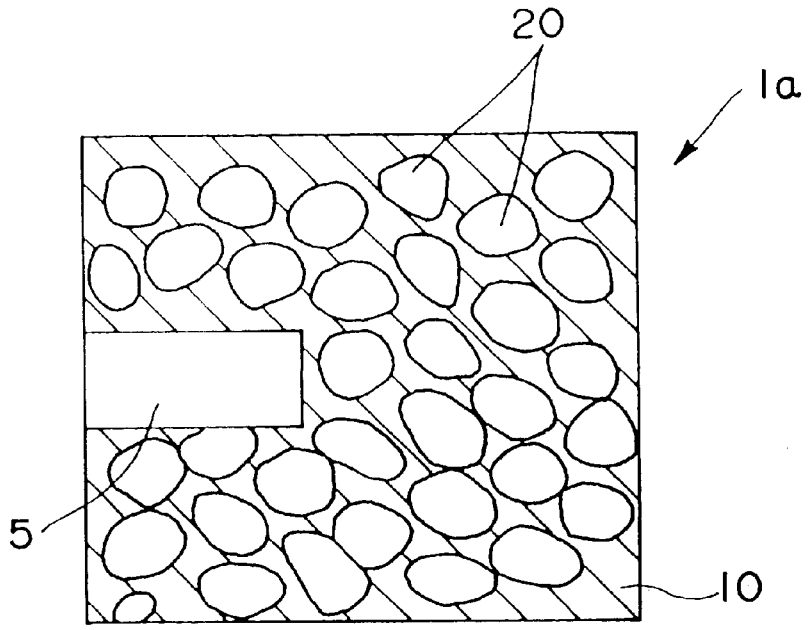
FIG. 7 is an illustration which shows a sectional structure (internal metallographic structure) of a green body after machine working performed in the second embodiment of the present invention.
Figure 8:
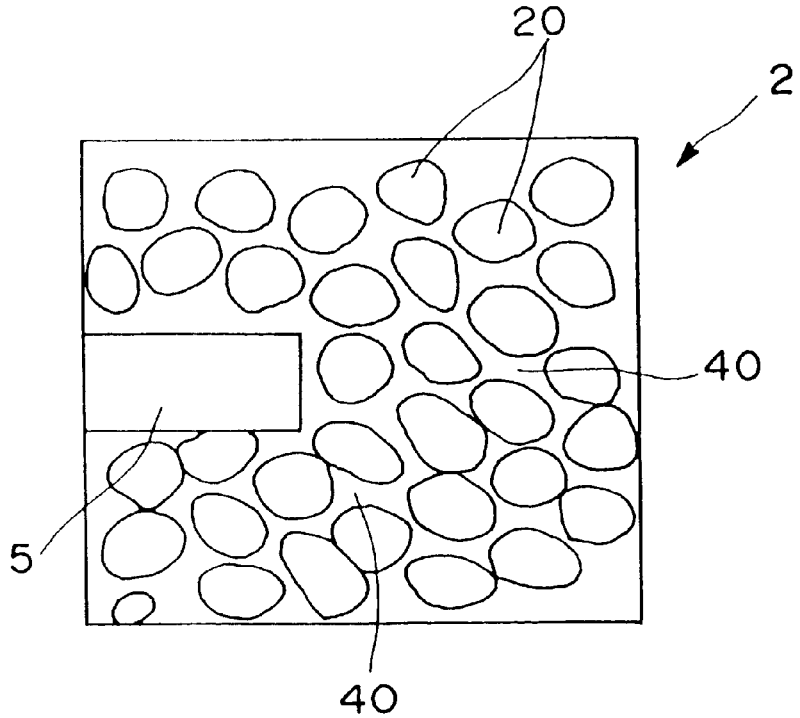
FIG. 8 is an illustration which shows a sectional structure (internal metallographic structure) of a green body (binder removed green body) after debinding treatment performed in the second embodiment of the present invention.
Figure 9:
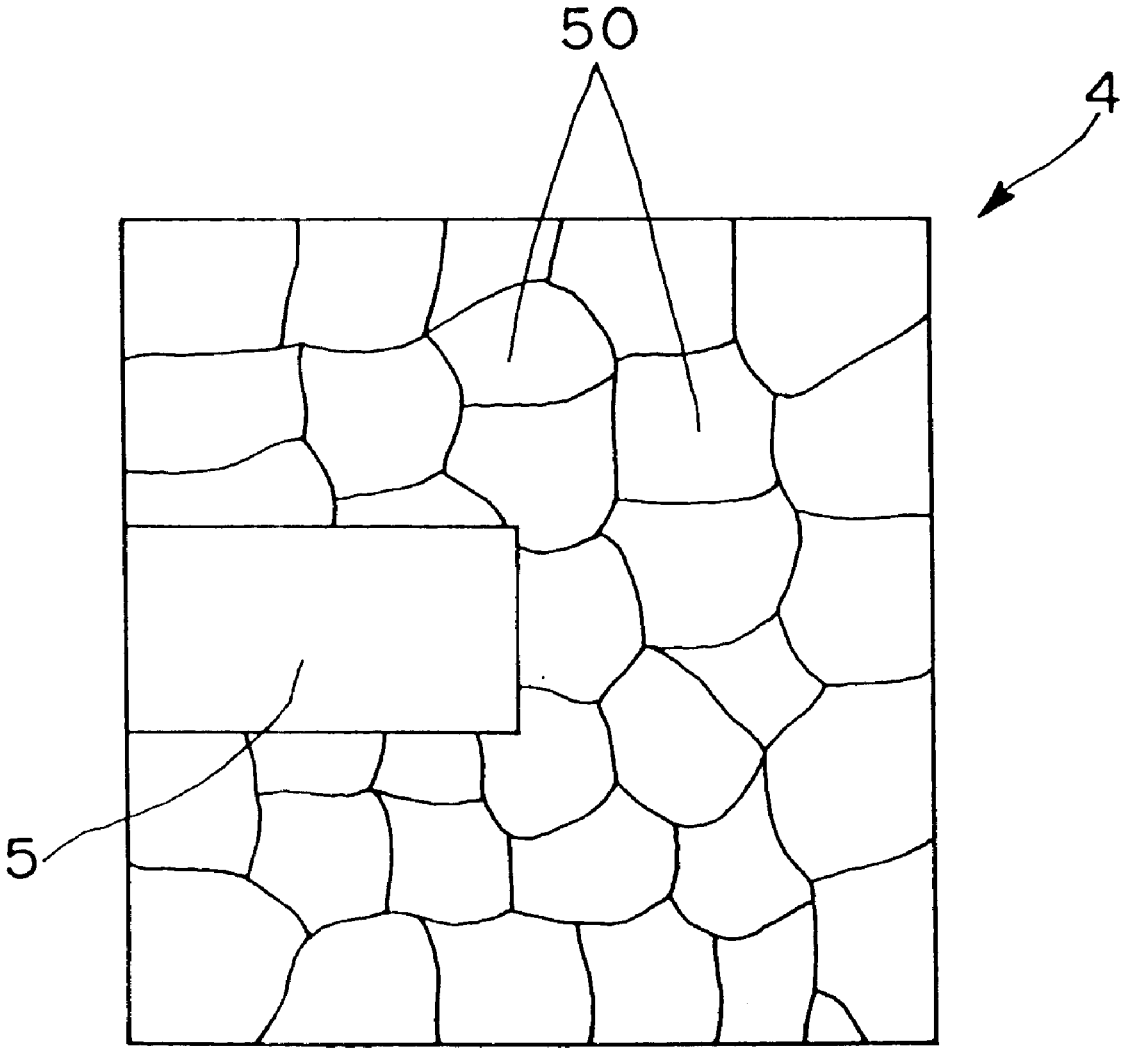
FIG. 9 is an illustration which shows a sectional structure (internal metallographic structure) of a sintered compact produced in accordance with the second embodiment of the present invention.

FIG. 2 is a step diagram which shows a second embodiment of a method of manufacturing sintered compacts according to the present invention; and FIGS. 7 to 9 are illustrations of sectional structure (internal metallographic structure) of a green body (or sintered compact), at each step after machine working. This second embodiment Is the same as the first embodiment except that a green body is machined after pressing. Hereinafter, a description will be given with reference to the drawings.

[1B] Production of Green Body

Same as in the step [1A] (see FIG. 3).

[2B] Pressing of Green Body

Same as in the step [2A] (see FIG. 4).

[3B] Machine Working Process

The green body 1*a* after pressing is subjected to a desired machine working. Examples of machine workings include drilling (as shown in FIG. 7), cutting, grinding, polishing, punching and the like. Any one or combination of two or more of the above may be used.

Since the hardness of the green body 1*a* is much lower than that of the sintered compact, these machine working processes may be carried out easily regardless of metal composition. In other words, workability for the green body is excellent than that for the sintered compact. Therefore, when forming a hole 5 or the like, it Is easy to control the shape and dimensions thereof, thus improving dimensional precision. This is advantageous in term of working complex and intricate shapes, compared to working of sintered compacts.

Since machine working (drilling) is performed on the green body 1*a* after the pressing thereof, that is, on the green body 1*a* that has been compacted to have improved metal powder dispersion, there is less variation in the shape and dimensions of the hole 5 (particularly, less dimensional error in the diameter and depth of the hole 5) in the final sintered compact 4, as compared with the case where a machine working process would be performed on an uncompacted green body. Therefore, it becomes possible to improve dimensional precision of the sintered compact.

In this regard, the shape and dimensions of the hole 5 to be formed on the green body 1*a* should be decided taking into account the estimated shrinkage that the green body will experience during the subsequent debinding and sintering treatments.

The same manner as in the above is also applied to machine working processes other than drilling.

The machine working processes described above may be performed during a step [4B] which will be described below (for example, between the intermediate debinding process and the final debinding process), between steps [4B] and [5B], or during a step [5B] (for example, between the first sintering stage and the second sintering stage).

[4B] Debinding Process for Debinding Green Body

Same as in the step [3A] (see FIG. 8).

[5B] Sintering of Green Body

Same as in the step [4A] (see FIG. 9).

Depending on a particular objective, the present invention may include a preliminary step coming before the step [1B], an intermediate step coming between the steps [1B] and [5B], or a post step coming after the step [5B].

THIRD EMBODIMENT

Figure 10:
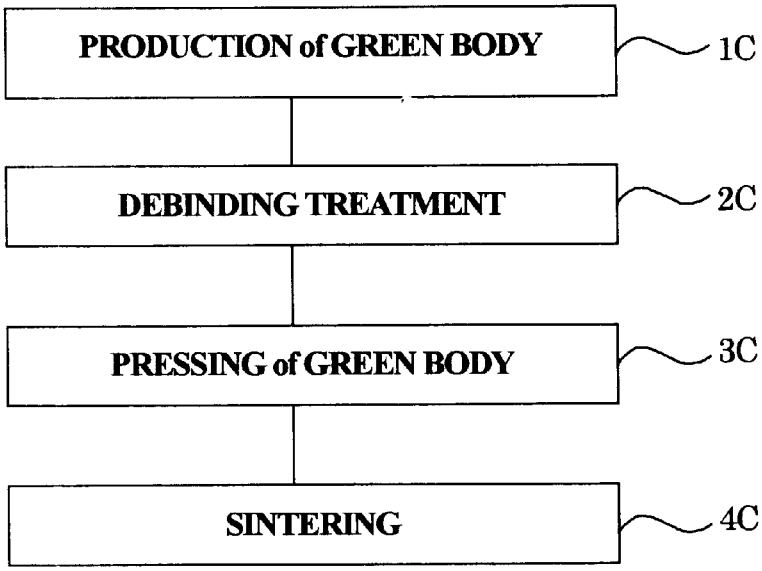
FIG. 10 is a step diagram which shows the third embodiment of a method of manufacturing sintered compacts according to the present invention.

FIG. 10 is a step diagram which shows a third embodiment of the manufacturing method of sintered compacts according to the present invention; and FIGS. 14 to 17 are illustrations of sectional structure (internal metallographic structure) of a green body, at each step. Hereinafter, with reference to the drawings, the third embodiment of the method of manufacturing sintered compacts will be described.

[1C] Production of Green body

Figure 14:
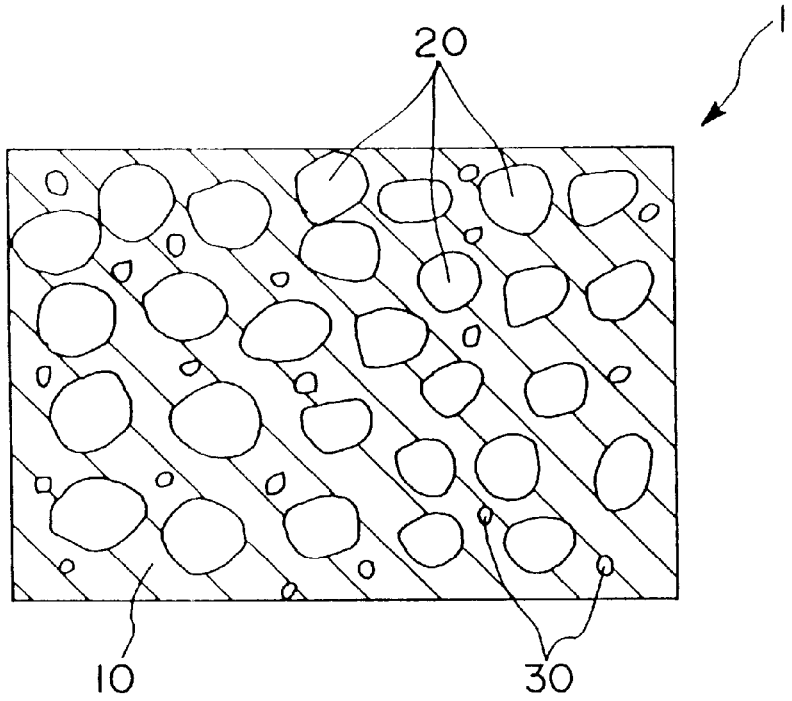
FIG. 14 is an illustration which shows a sectional structure (internal metallographic structure) of a green body at a step of producing the green body.

Same as in the step [1A] (see FIG. 14).

FIG. 14 shows the sectional structure of the produced green body 1. As shown in this figure, the metal powder 20 and pores 30 are substantially uniformly distributed throughout the binder 10.

The content of the metal powder in the green body 1 after the pressing and prior to the debinding treatment is preferably about 70 to 98 wt %, and more preferably about 82 to 98 wt %. When the content of the metal powder is lower than 70 wt %, the green body experiences greater shrinkage with sintering, and therefore dimensional precision is deteriorated. Further, the porosity and C content of the sintered compact tends to increase. On the other hand, when the content of the metal powder exceeds 98 wt %, the relative content of the binder 10 becomes too small, resulting in poor fluidity during injection molding. This makes injection molding difficult or impossible, or results in inhomogeneous green body composition.

[2C] Debinding Process for Debinding Green Body

The green body produced in the step [1C] is then subjected to a debinding treatment (binder removing treatment).

Debinding is effected by heat treatment under a non-oxidizing atmosphere such as under a vacuum or reduced pressure state ($1\times10^{-1}$ to $1\times10^{-6}$ torr, for example), or under an inert gas such as nitrogen gas, argon gas and the like.

In this case, conditions for debinding treatment are preferably about 0.5 to 40 hours at a temperature of about 150 to 750° C., and more preferably about 1 to 24 hours at a temperature of about 250 to 650° C.

In the same manner as in the step [3A], the debinding process by the heat treatment described above may be carried out in multiple steps (stages). Further, the debinding may also be carried out by means of some treatments other than the heat treatment.

Figure 15:
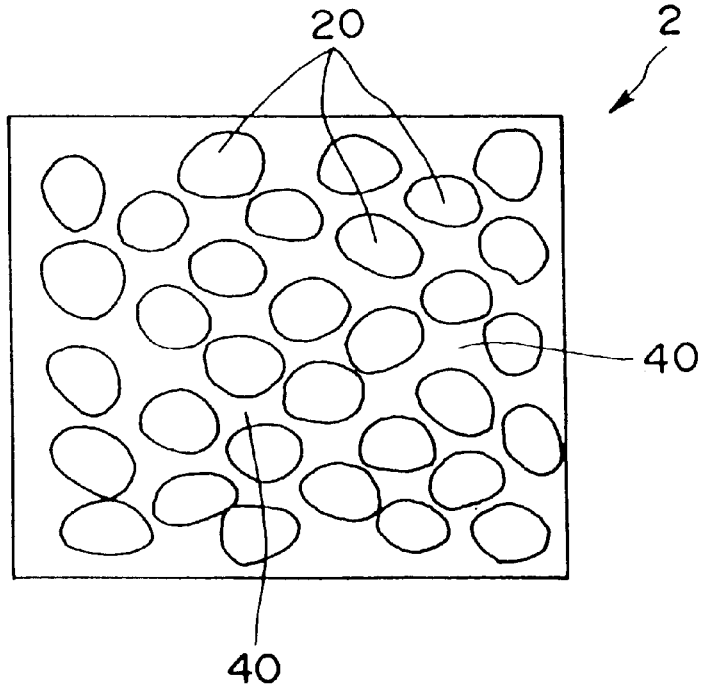
FIG. 15 is an illustration which shows a sectional structure (internal metallographic structure) of a green body (binder removed green body) after debinding treatment.

The sectional structure of the debinded green body 2 produced in this manner is shown in FIG. 15, in which pores 40 have formed where the binder 10 was formerly present.

[3C] Pressing of Green Body

The green body (debinded green body 2) obtained in the step [2C], which has been subjected to the debinding treatment, is then undergone pressing to pressure to effect compaction.

Pressing methods are not limited into any particular way. Examples of pressing methods include a method in which the green body is pressed in a predetermined direction such as rolling or pressing; and a method in which the green body is pressurized isotropically such as isostatic pressing. The latter method, particularly isostatic pressing, is preferred. In this connection, types of isostatic pressing, specific processes, conditions such as pressure and the like are the same as in the step [2A].

Figure 16:
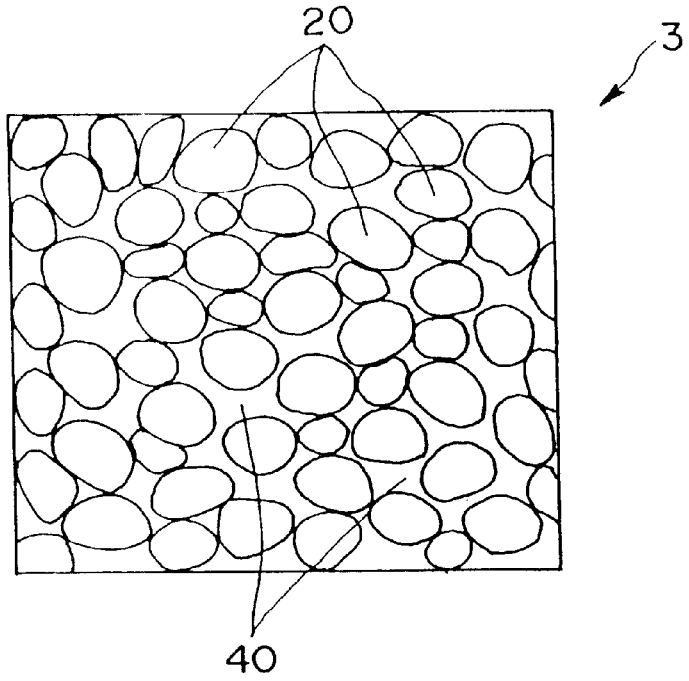
FIG. 16 is an illustration which shows a sectional structure (internal metallographic structure) of a green body after pressing.

The sectional structure of the green body 3 after pressing is shown in FIG. 16. This figure shows that the green body is compressed by pressing to have high density, and the number of pores 40 among the metal powder particles 20 is significantly reduced. In this case, depending on conditions for pressing, pores 40 may be virtually eliminated.

After the pressing, the coating film on the surface of the green body 3 may be peeled and removed. Typically, however, there is no need to provide separately a step of removing the coating film, since it can be eliminated by heat in the course of the subsequent sintering treatment.

[4C] Sintering of Green Body

The debinded and pressed green body 3 produced in the above-mentioned manner is then sintered in a sintering furnace to produce a metal sintered compact.

Figure 17:
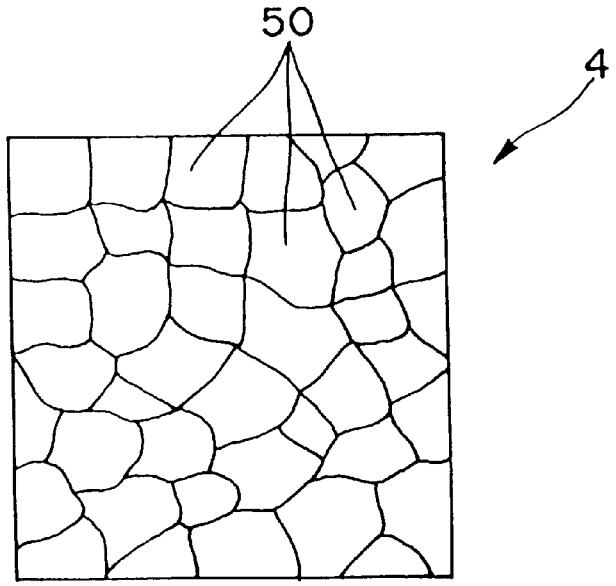
FIG. 17 is an illustration which shows a sectional structure (internal metallographic structure) of a sintered compact.

Diffusion and grain growth of the metal powder 20 are promoted by sintering, and thus grains 50 as shown in FIG. 17 are created. During the sintering, the pores 40 disappear to form a sintered compact 4 which is dense overall, that is, a sintered compact having high density and low porosity. Since the number of pores 40 in the green body has been appreciably reduced through the pressing prior to sintering, the sintered compact 4 has higher density and lower porosity than one which has not been subjected to pressing.

Sintering conditions such as sintering temperature, sintering time, sintering atmosphere, number of sintering steps and the like, and the actions and effects thereof are the same as those described in the step [4A].

Higher sintering temperatures are advantageous since they can shorten sintering time. On the other hand, however, if sintering temperature is too high, a large load is given to the sintering furnace and sintering jig, so that the life span thereof is shortened due to wear and the like. However, in the present invention, the pressing process in the step [3C] causes particles of the metal powder 20 to contact each other, which creates internal stress. Since such internal stress created by pressing is released when sintered, it becomes possible to cause diffusion of the metal at lower temperatures, which is advantageous in that sintering temperatures can be lowered and sintering time can be shortened. Such lower sintering temperatures contribute to improved sinterability, as a result facilitating sintering of metal compositions which were difficult to alloy in the past.

In this connection, it is to be noted that the sintering temperature may be changed (risen or lowered) with elapse of time within or outside of the range mentioned in the above, if desired.

Depending on a particular objective, the present invention may include a preliminary step coming before the step [1C], an intermediate step coming between the step [1C] and the step [4C], or a post step coming after the step [4C]. For example, a step for pressing the green body may come between the step [1C] and the step [2C].

FOURTH EMBODIMENT

Figure 11:
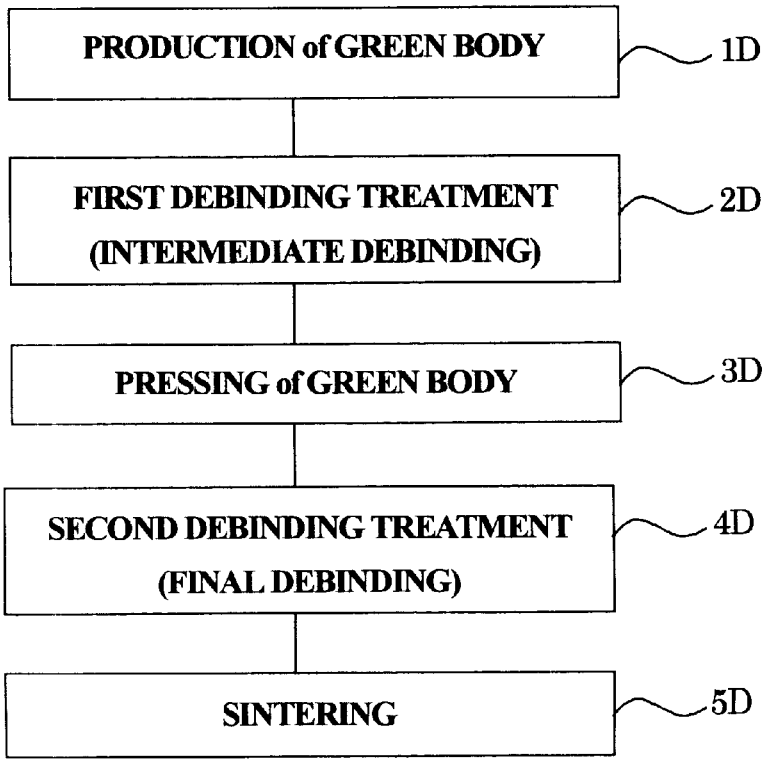
FIG. 11 is a step diagram which shows the fourth embodiment of a method of manufacturing sintered compacts according to the present invention.
Figure 18:
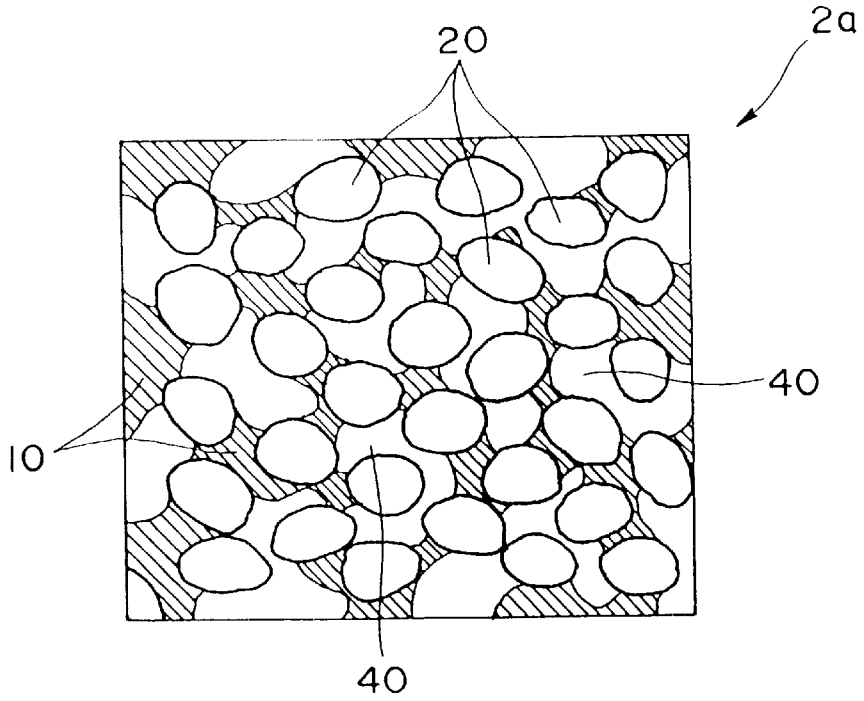
FIG. 18 is an illustration which shows a sectional structure (internal metallographic structure) of a green body after primary debinding treatment performed in each of the fourth and sixth embodiments of the present invention.
Figure 19:
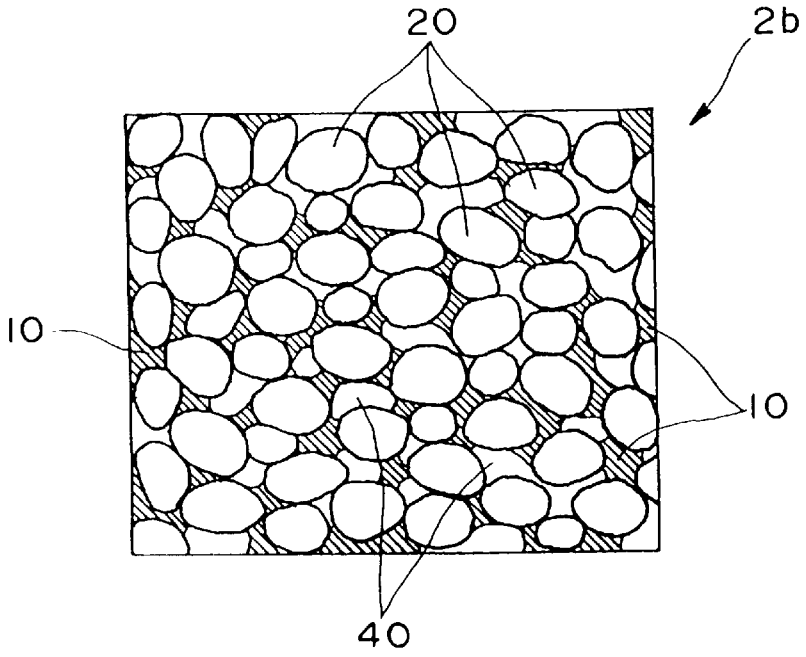
FIG. 19 is an illustration which shows a sectional structure (internal metallographic structure) of a green body after pressing performed in each of the fourth and sixth embodiments of the present invention.

FIG. 11 is a step diagram which shows a fourth embodiment of the method of manufacturing sintered compacts according to the present invention; and FIGS. 18 and 19 are illustrations of sectional structure (internal metallographic structure) of a green body after pressing which is carried out after a first debinding process. This fourth embodiment is the same as the third embodiment except that a green body is pressurized during a debinding treatment. Hereinafter, a description will be given with reference to the drawings.

[1D] Production of Green Body

Same as in the step [1C] (see FIG. 14).

In this regard, if atomization method is employed to produce metal powder in this embodiment, gas atomization method is preferably employed in this invention to produce metal powder. The reasons therefor are described later.

[2D] First Debinding Process for Debinding Green Body (Intermediate Debinding Process)

The green body obtained in the step [1D] is subjected to a debinding treatment (binder removed treatment). The debinding treatment is conducted in at least two stages, in which initial debinding is carried out in the first debinding process.

This first debinding process is carried out by means of heat treatment in a non-oxidizing atmosphere, such as under a vacuum or reduced pressure state ($1\times10^{-1}$ to $1\times10^{-6}$ torr, for example), or under an inert gas such as nitrogen gas, argon gas and the like.

In this case, conditions for debinding are preferably about 0.5 to 30 hours at a temperature of about 150 to 550° C., and more preferably about 1 to 20 hours at a temperature of about 250 to 450° C.

The debinding treatment may be accomplished by other methods (for example, by eluting predetermined components from the binder or additives with the aid of predetermined solvent (liquids, gases)).

The sectional structure of the green body 2*a* produced in this manner is shown in FIG. 18, in which some binder 10 remains with pores 40 being formed in areas where the binder 10 has been eliminated.

No limitation is imposed upon the residual fraction of binder 10 (that is, the residual amount of the binder 10 with respect to the total additional amount thereof). For example, the residual fraction of binder 10 may be within the range of about 10 to 95%, and especially 30 to 80%.

[3D] Pressing of Green Body

The green body 2*a* obtained in the step [2D] which has been subjected to the intermediate debinding treatment (the first debinding process) is undergone pressing effect compaction.

The pressing method, pressing temperature, pressure and the like are the same as in the step [3C].

Since the green body 2*a* to be pressurized contains some residual binder 10 that binds the metal powder 20 together, flaws of the green body 2*a* such as breaking, chipping and cracking and the like which are likely to occur during the pressing are reliably prevented.

This allows conditions for pressing and conditions relating to the green body to be set within a wide range. In this connection, this embodiment is particular suitable to the case where metal powder produced by a gas atomization method is used. The reason is as follows. Namely, metal powder produced by a gas atomization method includes particles which are roughly spherical in shape, and which have fewer surface irregularities (this results in weaker bonding strength between metal powder particles) than that produced by a water atomization method. Thus, in the case of production in accordance with the third embodiment which involves the pressing process after the debinding treatment, the particle size distribution of the metal powder must be relatively broad, or conditions such as pressure and the like must be regulated to optimal levels during pressing in order to prevent the flaws described earlier from occurring during pressing. However, the fourth embodiment is highly effective in preventing flaws from occurring in the green body 2*a* during pressing as described above, so that metal powder particle size and pressing conditions can be relaxed, that is, they can be selected from a broader range. Therefore, when the gas atomization method is used in this embodiment to produce metal powder, the mechanical properties of the final sintered compact can be improved. For these reason, this fourth embodiment is particularly useful to the case where metal powder produced by a gas atomization method is used.

In this regard, it is needless to say that similar advantages can be obtained using metal powder produced by a water atomization method and other methods, and therefore, it is possible to use powder produced by any one of these methods.

The sectional structure of the green body 2*b* after pressing is shown in FIG. 19. As shown in this figure, the green body 2*b* which has been compressed by the pressing has high density, and the number of pores 40 among the metal powder particles 20 is significantly reduced. In this case, depending on conditions for the pressing, pores 40 may be virtually eliminated. Some binder 10 which has not been eliminated in the course of the intermediate debinding process remains in metal powder 20.

After the pressing, the coating film on the surface of green body 2*b* may be peeled and removed. Typically, however, there is no need to provide separately a step for removing the coating film, since it can be eliminated by heat in the course of the subsequent second debinding or sintering treatment.

[4D] Second Debinding Process for Debinding Green Body (Final Debinding Process)

The pressed green body 2*b* produced in the step [3D] is subjected to a second (final) debinding process.

The second debinding process is carried out by means of heat treatment in a non-oxidizing atmosphere, such as under a vacuum or reduced pressure state ($1\times10^{-1}$ to $1\times10^{-6}$ torr, for example), or under an inert gas such as nitrogen gas, argon gas and the like.

In this case, conditions for debinding are preferably about 0.5 to 30 hours at a temperature of about 250 to 750° C., and more preferably about 1 to 20 hours at a temperature of about 300 to 650° C.

Debinding conditions such as debinding atmosphere, debinding temperature, debinding time and the like may be the same as or different from those in the first debinding process described earlier. In preferred practice, the debinding temperature will be set to a higher level than that in the first debinding process in order to effect good debinding.

Further, the second debinding process may be conducted in multiple steps (stages).

The debinding treatment may be accomplished, for example, by eluting predetermined components from the binder or additives with the aid of predetermined solvent (liquids, gases).

The sectional structure of the binder removed green body thus obtained is shown in FIG. 16, in which pores 40 is formed in areas from which the remaining binder 10 has been eliminated.

[5D] Sintering of Green Body

The binder removed green body produced in the above-mentioned manner is then sintered in a sintering furnace to produce a metal sintered compact.

Sintering conditions, action, effects, and sectional structure of the sintered compact (see FIG. 17) are the same as those in the steps [4A] and [4C].

Depending on a particular objective, the present invention may include a preliminary step coming before the step [1D], an intermediate step coming between the step [1D] and the step [5D], or a post step coming after the step [5D]. For example, a step for pressing the green body may come between the step [1D] and the step [2D] or between the step [4D] and the step [5D].

FIFTH EMBODIMENT

Figure 12:
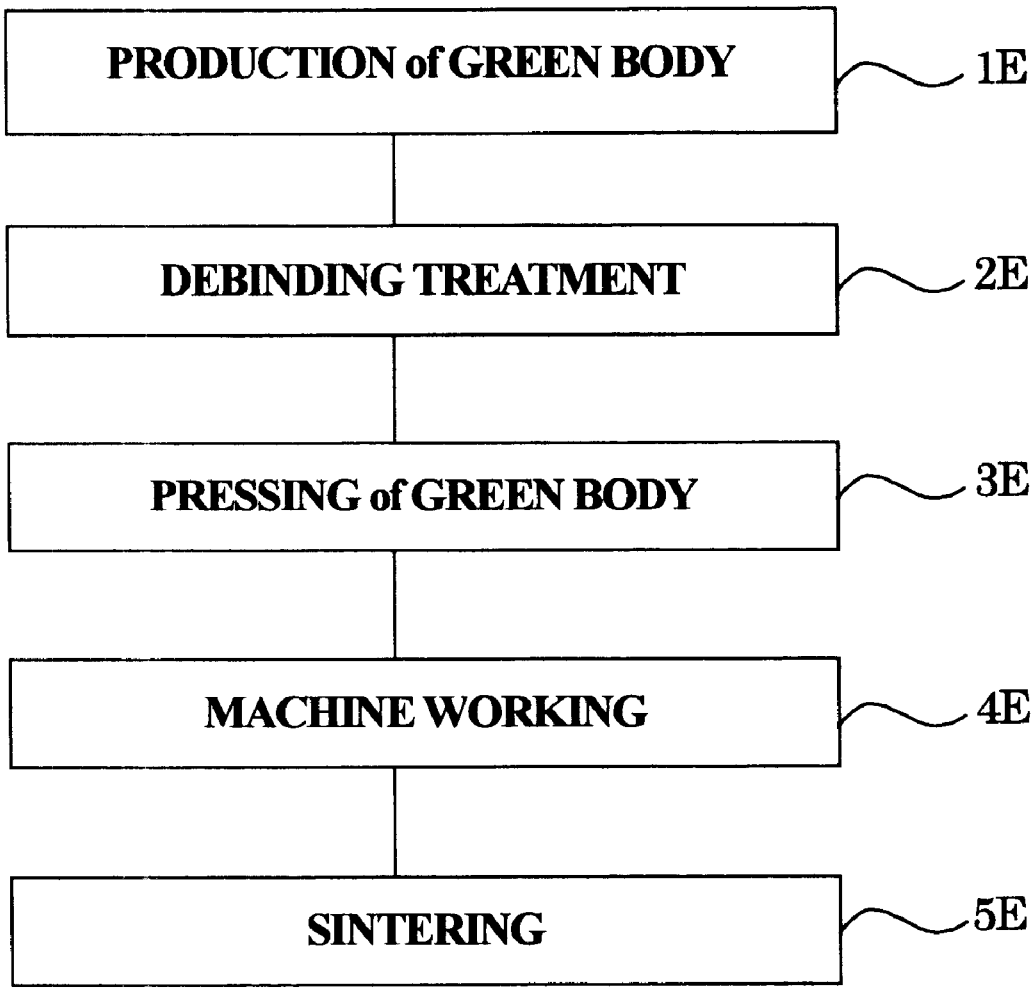
FIG. 12 is a step diagram which shows the fifth embodiment of a method of manufacturing sintered compacts according to the present invention.
Figure 20:
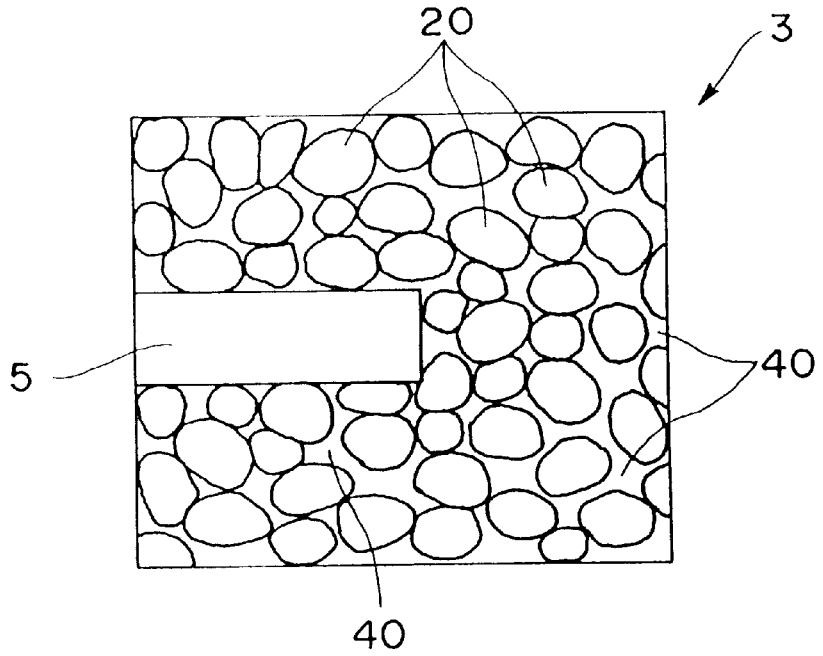
FIG. 20 is an illustration which shows a sectional structure (internal metallographic structure) of a green body after machine working performed in the fifth embodiment or after secondary debinding treatment performed in the sixth embodiment of the present invention.
Figure 21:
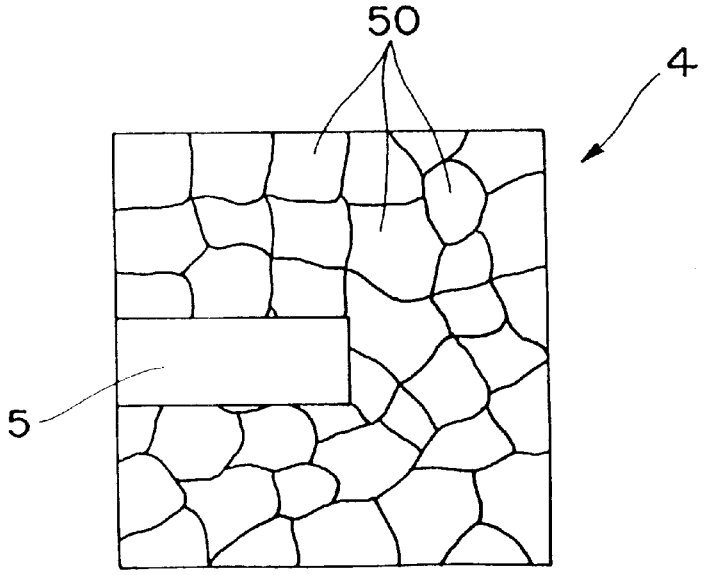
FIG. 21 is an illustration which shows a sectional structure (internal metallographic structure) of a sintered compact produced in accordance with each of the fifth and sixth embodiments of the present invention.

FIG. 12 is a step diagram which shows a fifth embodiment of the method of manufacturing sintered compacts according to the present invention; and FIGS. 20 and 21 are illustrations of sectional structure (internal metallographic structure) of a green body, at each step after machine working. This fifth embodiment is the same as the third embodiment except that a green body is machined after pressing. Hereinafter, a description will be given with reference to the drawings.

[1E] Production of Green Body

Same as in the step [1C] (see FIG. 14).

[2E] Debinding Process for Debinding Green Body

Same as in the step [2C] (see FIG. 15).

[3E] Pressing of Green Body

Same as in the step [3C] (see FIG. 16).

[4E] Machine Working Process

The green body after pressing is subjected to a desired machine working. Examples of machine workings include drilling (as shown in FIG. 20), cutting, grinding, polishing, punching and the like. Any one or combination of two or more of the above may be used.

Since the hardness of the green body prior to sintering (that is, binder removed green body) is a much lower than that of the sintered compact, these machine working processes may be carried out easily regardless of metal composition. In other words, workability of the green body is excellent than that for the sintered compact. Therefore, when forming a hole 5 or the like, it is easy to control the shape and dimensions thereof, thus improving dimensional precision. This is advantageous in terms of working complex and intricate shapes, compared to working of sintered compacts.

The green body has been compacted through the pressing subsequent to the debinding treatment, and as a result dispersibility of the metal powder has been improved. Therefore, when machine working (drilling) is performed on such a green body, there is less variation in the shape and dimensions of the hole 5 (in particular, less dimensional error in the diameter and depth of the hole 5) in the final sintered compact 4 in comparison with the case where machine working is performed on an undebinded green body or an unpressurized green body, thus leading to improved dimensional precision.

In this regard, the shape and dimensions of the hole 5 to be formed in the green body should be decided taking into account the estimated shrinkage that the green body will experience during the subsequent sintering treatment.

The same manner as in the above is also applied to machine working processes other than drilling.

The machine working processes described above may be performed during a step [5E] (described below). Namely, the machine working processes may be performed between first sintering stage (presintering process) and second sintering stage (main sintering process) in the case where the sintering is performed in multiple stages like the following step [5E].

[5E] Sintering of Green Body

Same as in the step [4C] (see FIG. 21).

Depending on a particular objective, the present invention may include a preliminary step coming before the step [1E], an intermediate step coming between the step [1E] and the step [5E], or a post step coming after the step [5E]. For example, a step for pressing the green body may come between the step [1E] and the step [2E] or between the step [4E] and the step [5E].

SIXTH EMBODIMENT

Figure 13:
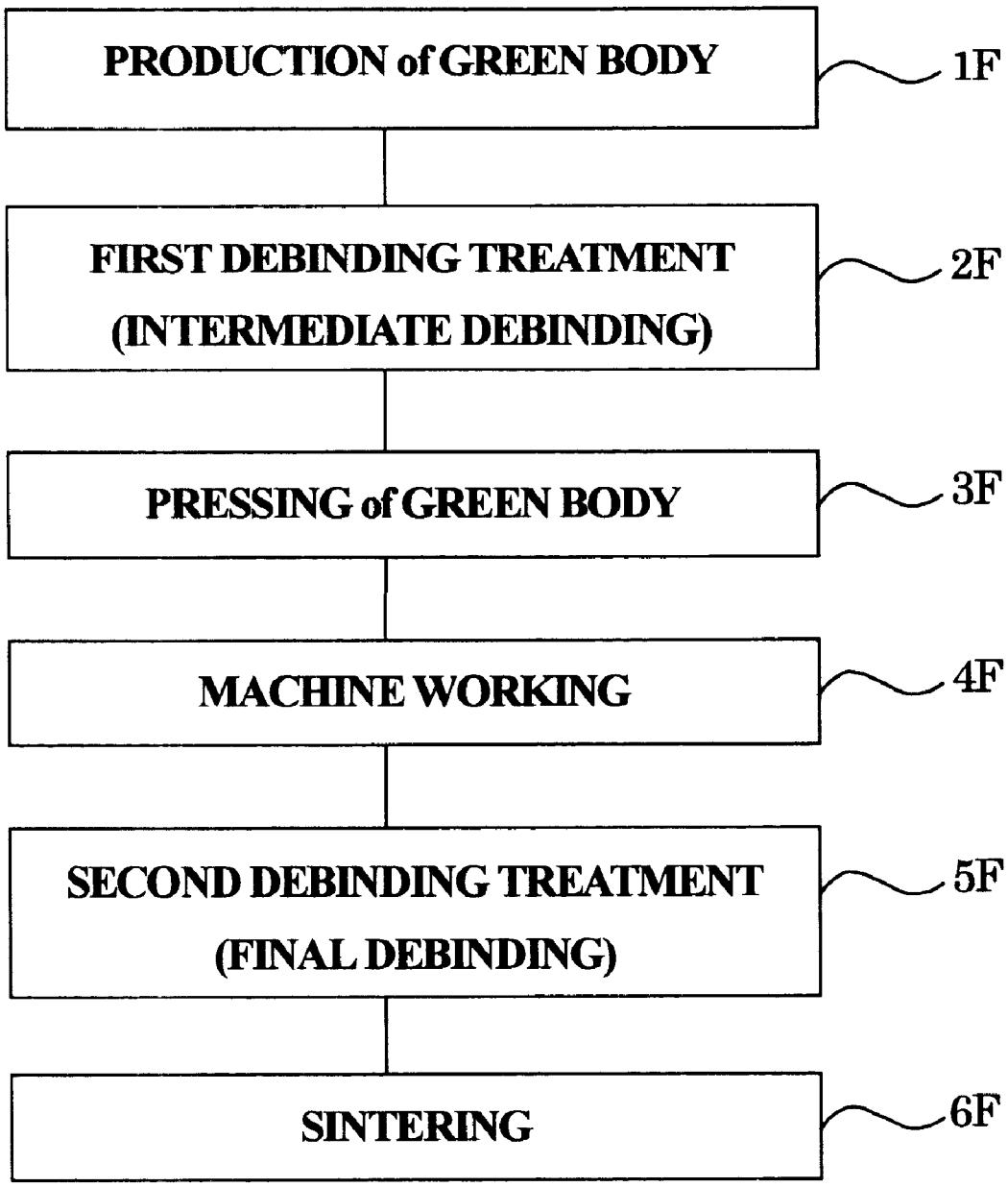
FIG. 13 is a step diagram which shows the sixth embodiment of a method of manufacturing sintered compacts according to the present invention.
Figure 22:
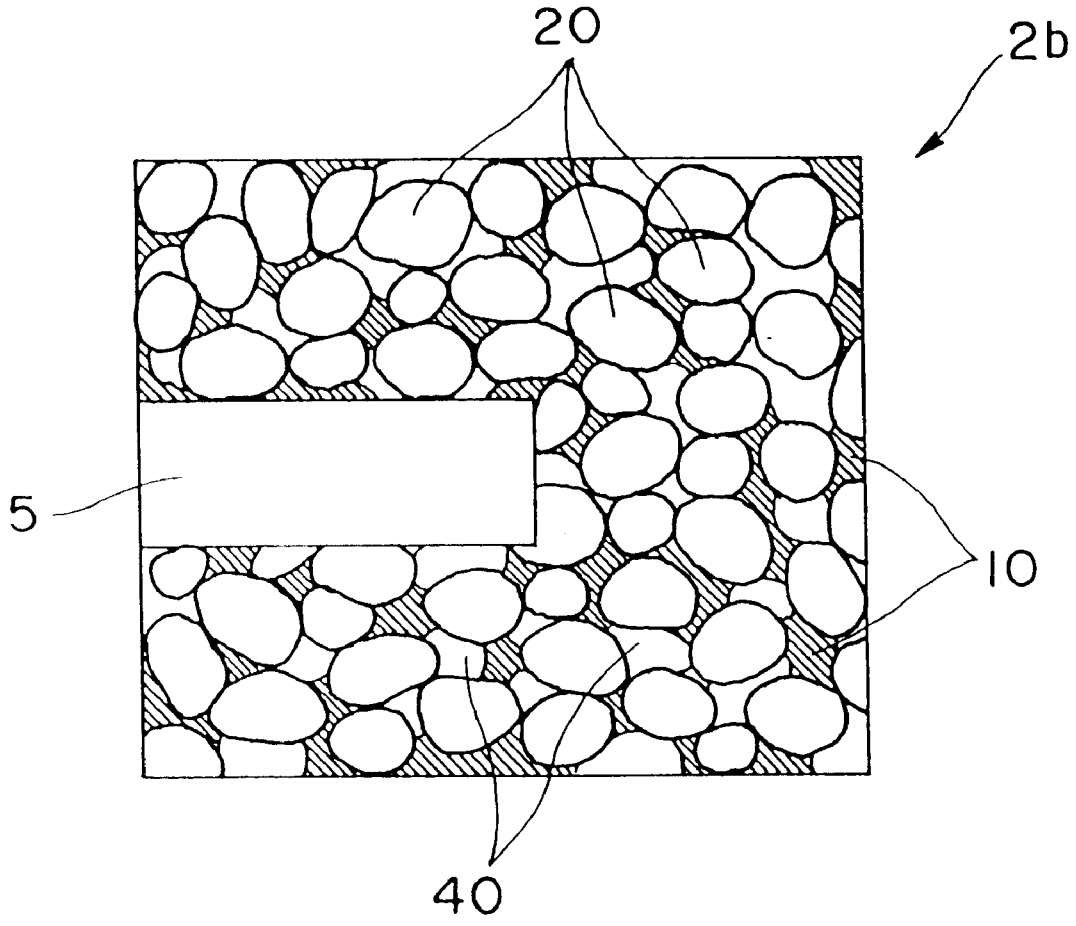
FIG. 22 is an illustration which shows a sectional structure (internal metallographic structure) of a green body after machine working performed in the sixth embodiment of the present invention.

FIG. 13 is a step diagram which shows a sixth embodiment of the method of manufacturing sintered compacts according to the present invention; and FIG. 22 is an illustration of sectional structure (internal metallographic structure) of a green body after machine working. This sixth embodiment is the same as the fourth embodiment except that a green body is machined after the pressing (particularly after the pressing of the green body and prior to the second debinding process). Hereinafter, a description will be given with reference to the drawings.

[1F] Production of Green Body

Same as in the step [1D] (see FIG. 14).

[2F] First Debinding Process for Debinding Green Body (Intermediate Debinding Process)

Same as in the step [2D] (see FIG. 18).

[3F] Pressing of Green Body

Same as in the step [3D] (see FIG. 19).

[4F] Machine Working Process

After pressing, the green body is subjected to a predetermined machine working process (see FIG. 22). The types of machine working process are the same as those discussed earlier in the step [4E].

Since the green body prior to sintering has a lower degree of hardness than a sintered compact, these machine working processes may be carried out easily regardless of metal composition. In other words, workability for the green body is excellent than that for a sintered compact. Therefore, when forming a hole 5 or the like, it is easy to control the shape and dimensions thereof, thus improving dimensional precision. This is advantageous in terms of working complex and intricate shapes, compared to working of sintered compacts.

The green body has been compacted through pressing subsequent to the intermediate debinding treatment (the first debinding process), and as a result it has improved dispersibility of metal powder. Therefore, when machine working (drilling) is performed on such a green body, there is less variation in the shape and dimensions of the hole 5 (in particular, less dimensional error in diameter and depth of hole 5) in the completed sintered compact 4 in comparison with the case where machine working would be performed on an undebinded green body or an unpressurized green body, thus leading to improved dimensional precision.

Further, as shown in FIG. 22, since the green body 2*b* subjected to machine working contains some residual binder 10 that binds the metal powder 20 together, flaws of the green body 2*b* such as breaking, chipping and cracking and the like which are likely to occur due to vibration, shock and the like during the machine working are reliably prevented.

In this regard, the shape and dimensions of the hole 5 to be formed in the green body should be decided taking into account the estimated shrinkage that the green body will experience during the subsequent sintering treatment.

The same manner as in the above is also applied to machine working processes other than drilling.

Such machine working processes may be performed between steps [5F] and [6F] (described below), or during the step [6F]. For example, in the case where sintering is carried out in multiple stages, machine working processes may be performed between the first sintering stage (presintering process) and the second sintering stage (main sintering process).

[5F] Second Debinding Treatment for Debinding Green Body (Final Debinding Treatment)

Same as in the step [4D].

The sectional structure of the green body 3 thus obtained is shown in FIG. 20, in which pores 40 are formed in areas from which the binder 10 has been eliminated. However, volume of pore 40 is low due to the previous compression during the pressing.

Deformation of the machined areas, that is, deformation of the hole 5 are negligible, and therefore high dimensional precision is maintained.

[6F] Sintering of Green Body

Same as in the step [5D] (see FIG. 21).

Depending on a particular objective, the present invention may include a preliminary step coming before the step [1F], an intermediate step coming between the step [1F] and the step [6F], or a post step coming after the step [6F]. For example, a step for pressing the green body may come between the step [1F] and the step [2F] or between the step [4F] and the step [5F]. Further, a step for pressing the green body after debinding may come between the step [5F] and the step [6F].

SEVENTH EMBODIMENT

Figure 23:
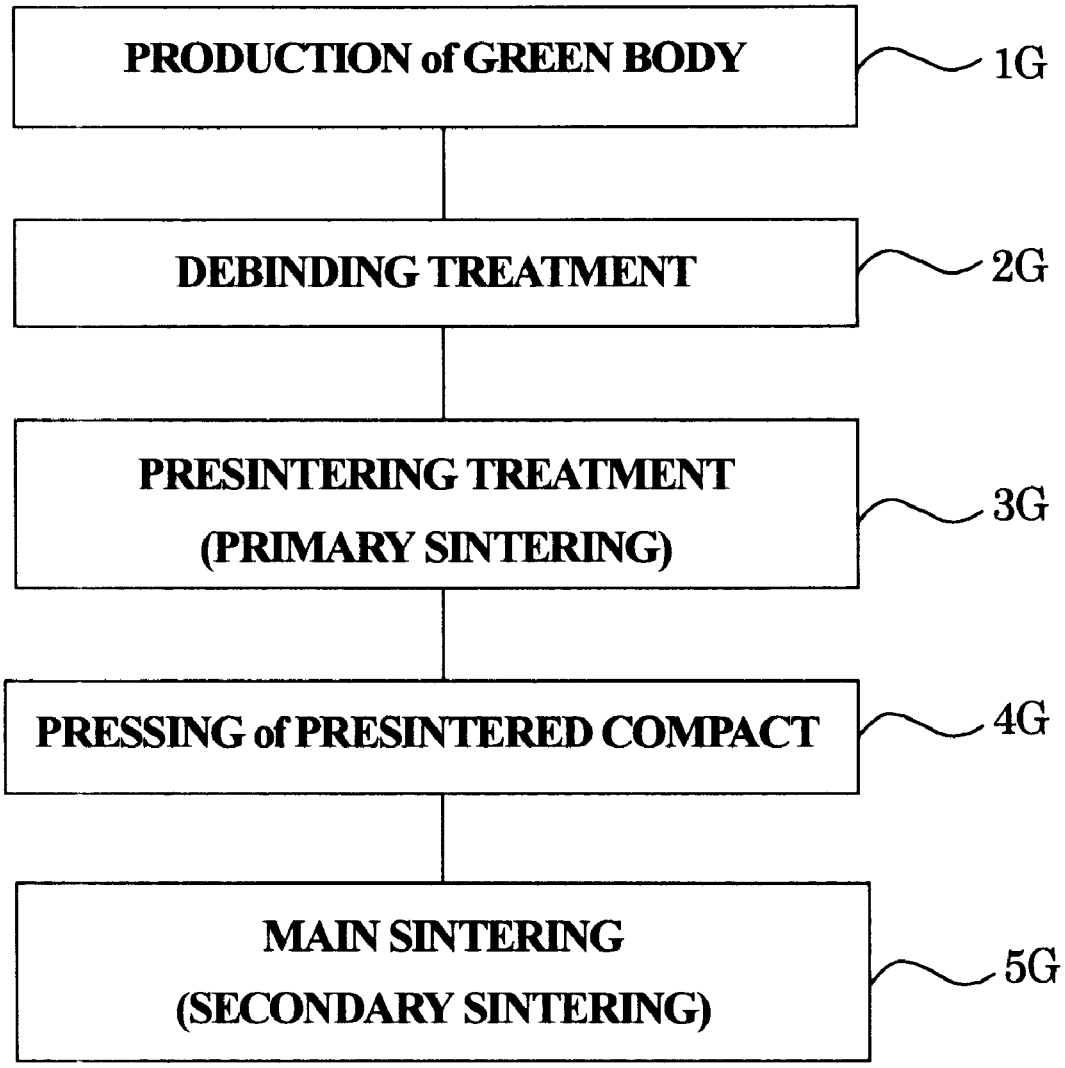
FIG. 23 is a step diagram which shows the seventh embodiment of a method of manufacturing sintered compacts according to the present invention.

FIG. 23 is a step diagram which shows a seventh embodiment of the method of manufacturing sintered compacts according to the present invention; and FIGS. 25 to 29 are illustrations of sectional structure (internal metallographic structure) of the green body, at each step. Hereinafter, a description of the seventh embodiment of the method of manufacturing sintered compacts will be given with reference to the drawings.

[1G] Production of Green Body

Figure 25:
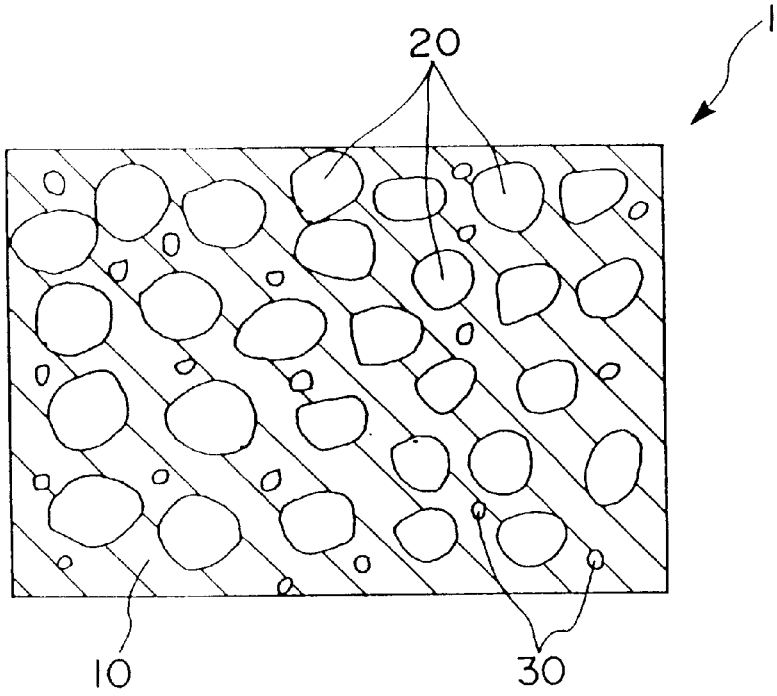
FIG. 25 is an illustration which shows a sectional structure (internal metallographic structure) of a green body at a step of producing the green body.

Same as in the step [1A] (see FIG. 25).

The sectional structure of the obtained green body 1 is shown in FIG. 25. As shown in this figure, the metal powder 20 and pores 30 are generally distributed uniformly throughout the binder 10.

In this connection, the preferred metal powder content of the green body 1 and the reasons therefor are the same as those discussed earlier in the step [1C].

[2G] Debinding Process for Debinding Green Body

Figure 26:
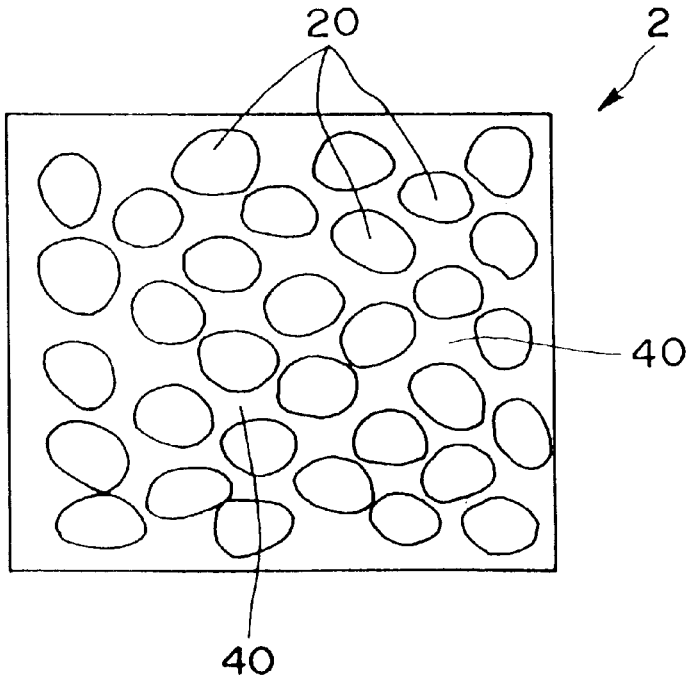
FIG. 26 is an illustration which shows a sectional structure (internal metallographic structure) of a green body (binder removed green body) after debinding treatment.

Same as in the step [1C] (see FIG. 26).

The sectional structure of the obtained debinded green body 2 is shown in FIG. 26, in which pores 40 are formed in areas where the binder 10 was formerly present.

[3G] Presintering (Primary Sintering)

The debinded green body 2 produced in the above-mentioned manner is sintered in a sintering furnace to effect presintering.

In preferred practice, the presintering of the debinded green body 2 is continued until particles of the metal powder 20 undergo diffusion bonding, at least at the points of contact thereof. Conducting the presintering in this way increases the shape stability. As a result, it becomes possible to reliably prevent various flaws of the green body (presintered compact) such as breaking, chipping, cracking and the like from occurring in subsequent steps, particularly in the pressing step for compacting the green body, thus facilitating handling thereof.

In particular, the use of metal powder produced by a gas atomization method is preferred due to the following advantages.

Namely, metal powder produced by a gas atomization method includes particles which are roughly spherical in shape, and which have fewer surface irregularities (this results in weaker bonding strength between metal powder particles) than that produced by a water atomization method. Thus, in the case where the green body which has not undergone the presintering treatment is subjected to the pressing, the particle size distribution of the metal powder must be relatively broad, or conditions such as pressure and the like must be regulated to optimal levels during pressing in order to prevent the flaws described earlier from occurring during pressing. However, the presintering treatment is highly effective in preventing flaws from occurring in the green body during pressing as described above, so that metal powder particle size and pressing conditions can be relaxed, that is, they can be selected from a broader range. Therefore, when the gas atomization method is used in this embodiment to produce metal powder, the mechanical properties of the final sintered compact can be improved. For these reason, this invention is particularly useful to the case where metal powder produced by a gas atomization method is used.

In this regard, it is needless to say that similar advantages can be obtained using metal powder produced by a water atomization method and other methods, and therefore, it is possible to use powder produced by any one of these methods.

In the case where the metal composition is, for example, Fe or Fe-base alloy, the sintering temperature during such a presintering is preferably about 700 to 1300° C., and more preferably about 800 to 1250° C. Further, in the case where the metal composition is Ti or a Ti-base alloy, the sintering temperature is preferably about 700 to 1200° C., and more preferably about 800 to 1150° C. Furthermore, in the case where the metal composition is W or W-base alloy, it is preferably about 700 to 1400° C., and more preferably about 800 to 1350° C.

In this connection, it is to be noted that the sintering temperature during presintering may be changed (risen or lowered) with elapse of time within or outside of the range mentioned in the above, if desired.

In the case where the sintering temperatures given in the above are employed, sintering time for presintering is preferably about 0.2 to 6 hours and more preferably about 0.5 to 4 hours.

In preferred practice, the sintering atmosphere is a non-oxidizing atmosphere that does not contain hydrogen. This improves safety in sintering, and contributes to reduced porosity in the sintered compact.

The preferred sintering atmosphere is one under a reduced pressure (a vacuum) of $1\times10^{-2}$ torr or lower (more preferably $1\times10^{-2}$ to $1\times10^{-6}$ torr), or under an inert gas such as nitrogen gas, argon gas and the like at 1 to 760 torr.

The sintering atmosphere can be changed during the presintering. For example, the sintering atmosphere, which has been initially set to a reduced pressure (a vacuum) of $1\times10^{-2}$ to $1\times10^{-6}$ torr, may be changed into the atmosphere under the inert gases mentioned in the above during the presintering.

Figure 27:
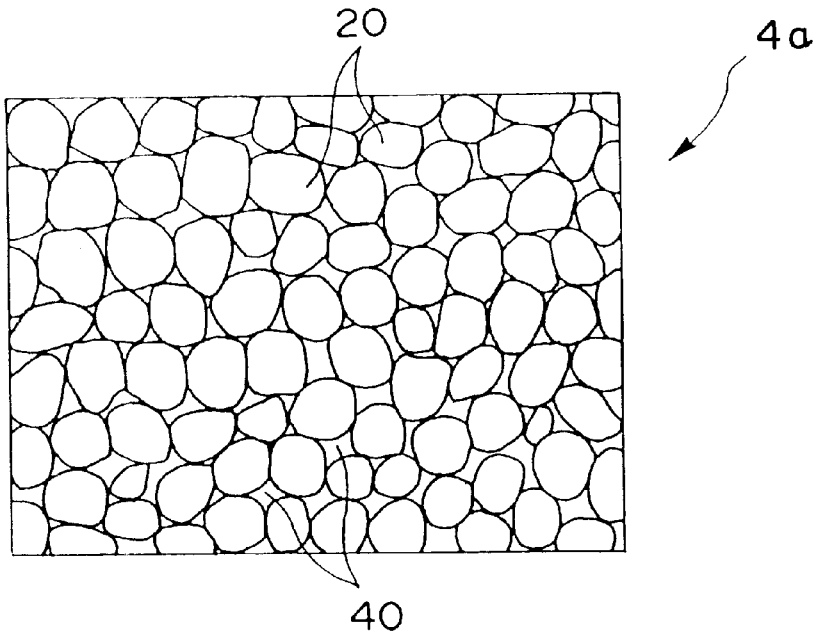
FIG. 27 is an illustration which shows a sectional structure (internal metallographic structure) of a presintered compact after presintering treatment.

The sectional structure of the obtained presintered compact (presintered green body) 4*a* is shown in FIG. 27, in which the contact points of particles of the metal powder 20 undergo diffusion bonding, and therefore pores 40 are reduced in number.

[4G] Pressing of Presintered Compact

Pressure is applied to the green body (presintered compact 4*a*) produced in the step [3G] to effect compaction thereof.

The pressing method is not limited into any particular way. Examples of pressing methods include a method in which the presintered compact 4*a* is pressed in a predetermined direction, such as rolling or pressing; and a method in which the presintered compact 4*a* is pressurized isotropically, such as isostatic pressing. The latter method, particularly isostatic pressing, is preferred. In this connection, types of isostatic pressing, specific methods, conditions such as pressure and the like are the same as those discussed earlier in the step [2A].

Figure 28:
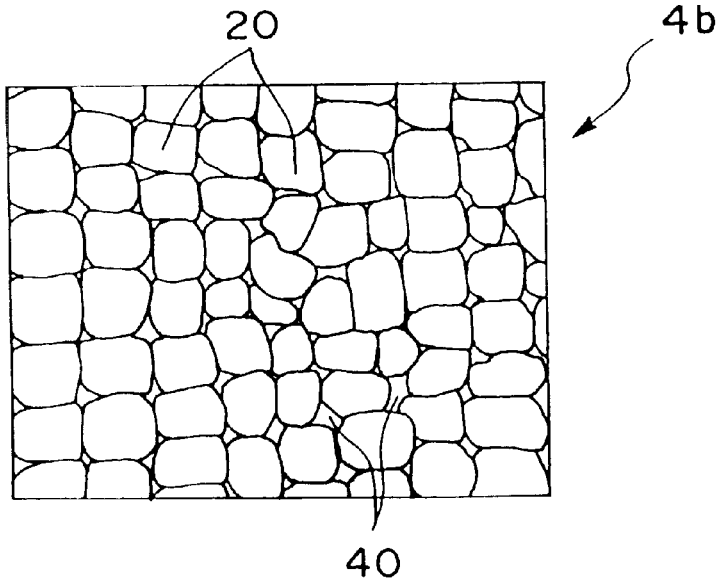
FIG. 28 is an illustration which shows a sectional structure (internal metallographic structure) of a presintered compact after pressing.

The sectional structure of the pressed presintered compact 4*b* is shown in FIG. 28. As shown in this figure, the presintered compact 4*a* which has been compressed by pressing has high density, and the number of pores 40 among the metal powder particles 20 further reduced as compared to the presintered compact 4*a* prior to the pressing. In this case, depending on conditions for the pressing, pores 40 can be significantly reduced in number so that pores 40 can be virtually eliminated.

After the pressing, the coating film on the surface of presintered compact 4*b* may be peeled and removed. Typically, however, there is no need to provide separately a step for removing the coating film, since it can be eliminated by heat in the course of the subsequent main sintering process.

[5G] Main Sintering (Secondary Sintering)

The pressed presintered compact 4*b* produced in the above-mentioned manner is sintered in a sintering furnace to effect main sintering (final sintering) in order to produce a metal sintered compact.

Figure 29:
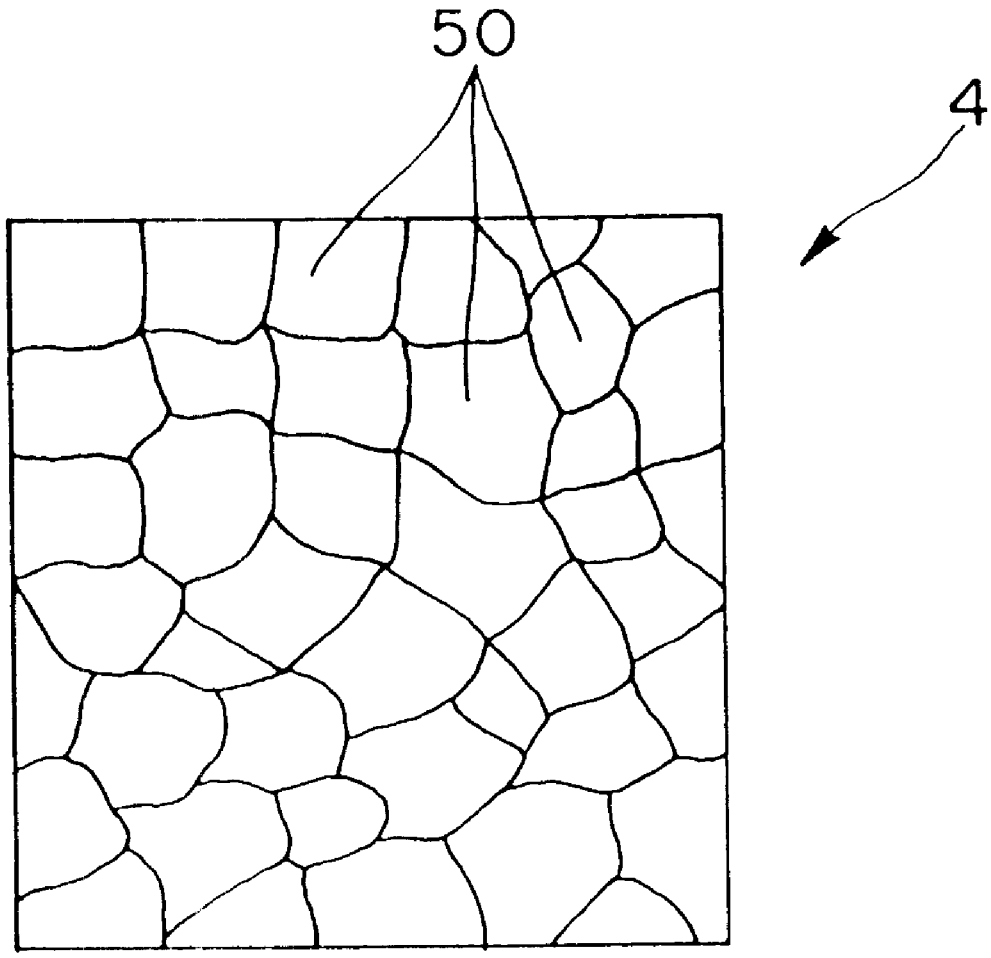
FIG. 29 is an illustration which shows a sectional structure (internal metallographic structure) of a sintered compact after main sintering treatment.

As shown in FIG. 29, the main sintering brings diffusion and grain growth of metal powder 20 to form crystal grains 50. The pores 40 disappear to form a sintered compact 4 which is dense overall, that is, a sintered compact 4 having high density and low porosity.

In particular, since the number of pores 40 in the presintered compact 4*b* has been appreciably reduced through the pressing, the main sintering enables to provide a sintered compact 4 having higher density and lower porosity as compared with the case where no pressing has been carried out before the main sintering.

In the case where the metal composition is, for example, Fe or Fe-base alloy, the sintering temperature during main sintering is preferably about 950 to 1400° C., and more preferably about 1100 to 1350° C. Further, in the case where the metal composition is Ti or a Ti-base alloy, the sintering temperature is preferably about 900 to 1350° C., and more preferably about 1000 to 1300° C. Further more, in the case where the metal composition is W or W-base alloy, it is preferably about 1100 to 1600° C., and more preferably about 1200 to 1500° C. In this case, the sintering temperature during the main sintering is preferably higher than that of the presintering.

In general, higher sintering temperatures are advantageous since they can shorten sintering time. On the other hand, however, if sintering temperature is too high, a large load is given to the sintering furnace and sintering jig, so that the life span thereof is shortened due to wear and the like. However, in the present invention, the pressing process in the step [4G] causes particles of the metal powder 20 in the presintered compact to contact each other, which creates internal stress. Since such internal stress created by pressing is released when sintered, it becomes possible to cause diffusion of the metal at lower temperatures, which is advantageous in that sintering temperatures can be lowered and sintering time can be shortened. Such lower sintering temperatures contribute to improved sinterability, as a result facilitating sintering of metal compositions which were difficult to alloy in the past.

In this connection, it is to be noted that the sintering temperature during the main sintering may be changed (risen or lowered) with elapse of time within or outside of the range mentioned in the above, if desired.

In the case where the sintering temperatures given in the above are employed, sintering time for main sintering is preferably about 0.5 to 8 hours and more preferably about 1 to 5 hours.

In preferred practice, the sintering atmosphere is a non-oxidizing atmosphere that does not contain hydrogen. This improves safety in sintering, and contributes to reduced porosity in the sintered compact.

The preferred sintering atmosphere is one under a reduced pressure (a vacuum) of $1\times10^{-2}$ torr or lower (more preferably $1\times10^{-2}$ to $1\times10^{-6}$ torr), or under an inert gas such as nitrogen gas, argon gas and the like at 1 to 760 torr.

The sintering atmosphere can be changed during the main sintering. For example, the sintering atmosphere, which has been initially set to a reduced pressure (a vacuum) of $1\times10^{-2}$ to $1\times10^{-6}$ torr, may be changed into the atmosphere under the inert gases mentioned in the above during the main sintering.

The sintering atmosphere for the main sintering may be the same as or different from that for the presintering.

Conducting presintering and main sintering under the conditions described above contributes to reduced porosity, that is, higher density of the sintered compact, and enables to obtain high dimensional precision. Further, performing the sintering in multiple step enables to carry out sintering treatment effectively, which results in a shorter sintering time, and realize to a high safety in sintering operation, thereby making it possible to improve productivity in manufacturing sintering compacts.

Depending on a particular objective, the present invention may include a preliminary step coming before the step [1G], an intermediate step coming between the steps [1G] and [4G], or a post step coming after the step [4G]. For example, a step of pressing the green body may come between the steps [1G] and [2G], during the step [2G], or between the steps [2G] and [3G].

EIGHTH EMBODIMENT

Figure 24:
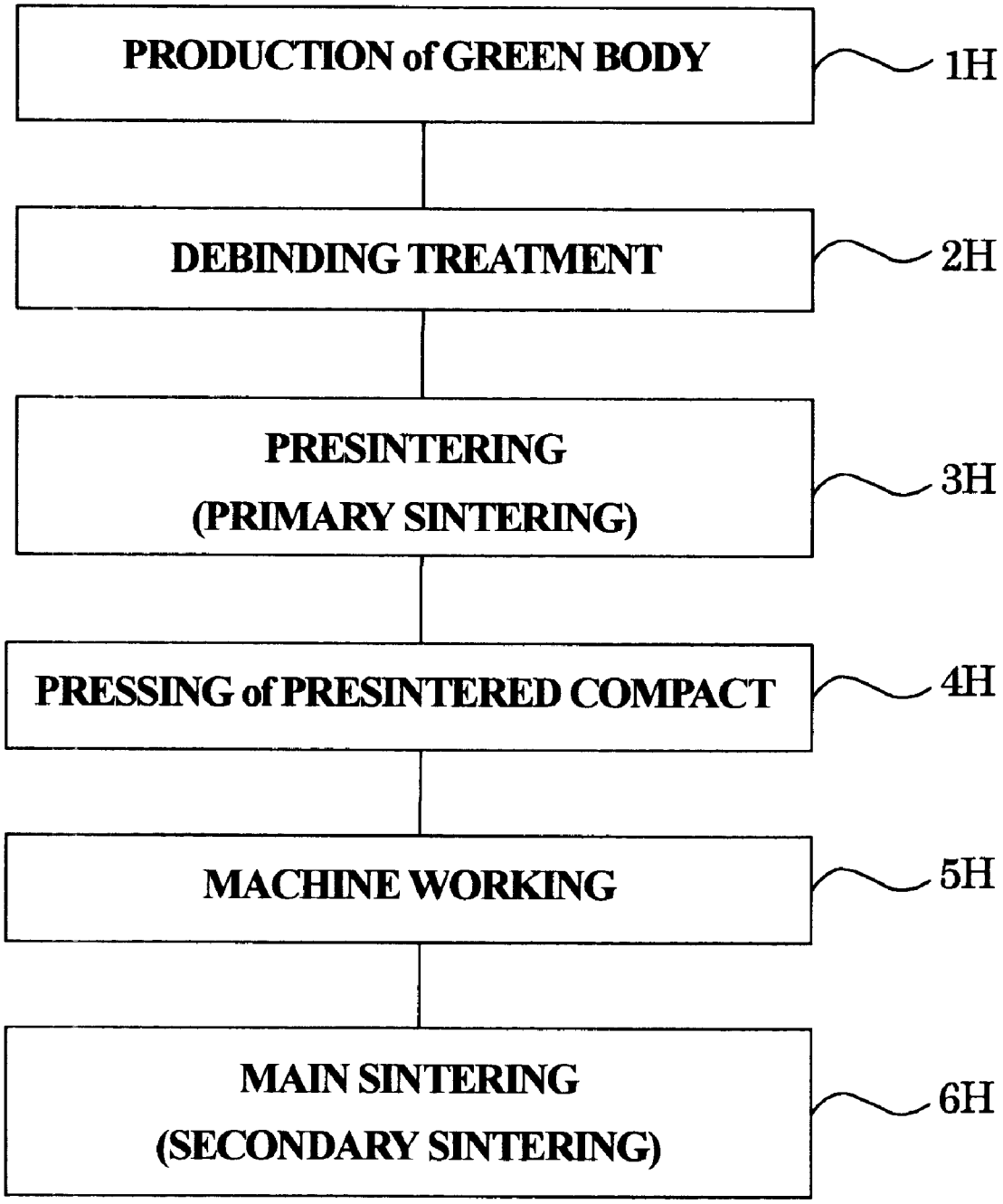
FIG. 24 is a step diagram which shows the eighth embodiment of a method of manufacturing sintered compacts according to the present invention.
Figure 30:
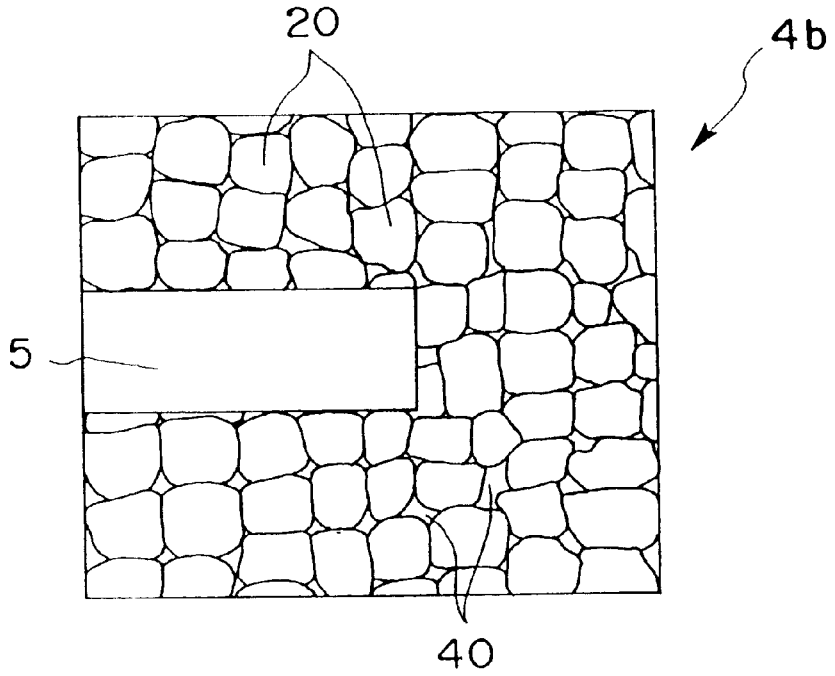
FIG. 30 is an illustration which shows a sectional structure (internal metallographic structure) of a presintered compact after machine working performed in the eighth embodiment of the present invention.
Figure 31:
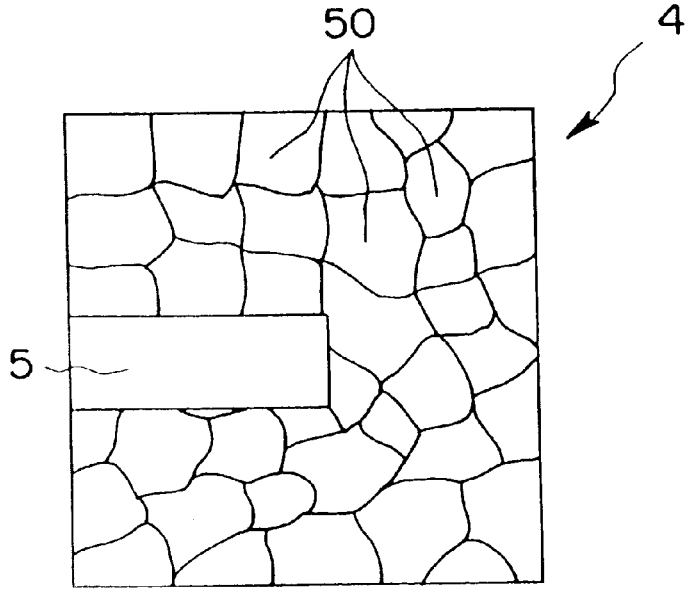
FIG. 31 is an illustration which shows a sectional structure (internal metallographic structure) of a presintered compact after main sintering treatment performed in the eighth embodiment of the present invention.

FIG. 24 is a step diagram which shows an eighth embodiment of the method of manufacturing sintered compacts according to the present invention; and FIGS. 30 and 31 are illustrations of sectional structure (internal metallographic structure) of a presintered compact, at each step after machine working. This eighth embodiment is the same as in the seventh embodiment except that a presintered compact is machined after pressing it. Hereinafter, a description will be given with reference to the drawings.

[1H] Production of Green Body

Same as in the step [1G] (see FIG. 25).

[2H] Debinding Process for Debinding Green Body

Same as in the step [2G] (see FIG. 26).

[3H] Presintering (Primary Sintering)

Same as in the step [3G] (see FIG. 27).

[4H] Pressing of Presintered Compact

Same as in the step [4G] (see FIG. 28).

[5H] Machine Working Process

The presintered compact 4*b* after pressing is subjected to a desired machine working. Examples of machine workings include drilling (as shown in FIG. 30), cutting, grinding, polishing, punching and the like. Any one or combination of two or more of the above may be used.

Since the hardness of the presintered compact 4*b* after the pressing is lower than that of the sintered compact after the main sintering, these machine working processes may be carried out easily regardless of metal composition. In other words, workability for the presintered compact 4*b* after the pressing is excellent than that for the sintered compact after the main sintering. Therefore, when forming a hole 5 or the like, it is easy to control the shape and dimensions thereof, thus improving dimensional precision. This is advantageous in terms of working complex and intricate shapes, compared to working of sintered compacts after the main sintering.

The presintered compact 4*b* has been compacted through the pressing. Therefore, when machine working (drilling) is performed on such a presintered compact 4*b*, there is less variation in the shape and dimensions of the hole 5 (in particular, less dimensional error in diameter and depth of the hole 5) in the completed sintered compact 4 in comparison with the case where machine working would be performed on a debinded green body or an uncompacted presintered compact, thus leading to improved dimensional precision.

In this regard, the shape and dimensions of a hole 5 to be formed in the presintered compact 4*b* should be decided taking into account the estimated shrinkage that the presintered compact 4*b* will experience during the main sintering process (described later). Here, shrinkage of the final sintered compact 4 relative to the presintered compact 4*b* after pressing is less than shrinkage of the final sintered compact 4 relative to the debinded green body 2 or the presintered compact 4*a* prior to pressing, so dimensional error can be minimized by drilling the hole 5 in the presintered compact 4*b* after pressing thereof. That is, the dimensions of the hole 5 in the final sintered compact 4 will be closer to the target dimensions (design value), thus improving dimensional precision in this respect as well.

The same manner as in the above is also applied to machine working processes other than drilling.

[6H] Main Sintering

Same as in the step [5G] (see FIG. 31).

Depending on a particular objective, the present invention may include a preliminary step coming before the step [1H], an intermediate step coming between the steps [1H] and [6H], or a post step coming after the step [6H]. For example, a step of pressing the green body may come between the steps [1H] and [2H], during the step [2H], or between the steps [2H] and [3H].

EXAMPLES

Hereinafter, specific examples of the manufacturing method of sintered compacts according to the present invention will be described.

Example 1a

As for metal powder, a stainless steel (SUS 316/composition: Fe-18Cr-12Ni-2.5Mo alloy) powder of 9 $\mu$m mean particle size was prepared by a gas atomization method.

A binder including 1.9 wt % of polystyrene (PS), 1.8 wt % of an ethylene-vinyl acetate copolymer (EVA) and 1.5 wt % of paraffin wax; and 0.8 wt % of dibutyl phthalate (plasticizer) were mixed with 94 wt % of the prepared metal powder. The mixture containing these components were compounded in a compounding machine under the conditions of 115° C.×1 hour.

Then, the obtained feed stock was pelletized and classified to produce pellets of 3 mm mean particle size. Using these pellets, metal injection molding (MIM) was performed with an injection molding machine to produce 200 cylindrical green bodies of 11.5 mm diameter×28.7 mm height (target dimensions after sintering treatment were 10 mm diameter×25 mm height). Molding conditions during the injection molding were mold temperature of 30° C. and injection pressure of 110 kgf/cm$^2$.

The metal powder content of the produced green body was about 93.6 wt %.

An isoprene rubber coating film (thickness 0.3 mm) was formed on the surface of each green body in accordance with a dipping process. The green bodies coated with the coating film were set in an isostatic pressing machine (produced by Kabushiki Kaisha Kobe Seikosho) and then subjected to an isostatic pressing (CIP). In this process, conditions were 22° C. temperature, 6 t/cm$^2$ pressure. At this point, the metal powder content of the green body was about 93.9 wt %.

After the isostatic pressing, the green bodies were subjected to a debinding treatment in a debinding furnace. This debinding treatment was carried out under the conditions of reduced pressure of $1\times10^{-3}$ torr at a temperature of 300° C. for one hour, and then the temperature was raised to 500° C. and such condition was being kept for another one hour. The coating film on each green body was eliminated in the course of the debinding treatment.

Next, the binder removed green bodies which had been obtained through the debinding treatment were sintered in a sintering furnace to produce sintered compacts. Sintering conditions were 1300° C.×3 hours in an Ar gas atmosphere.

Example 2a

Sintered compacts were produced in the same manner as in Example 1a, except that conditions for isostatic pressing (CIP) were changed into 22° C. temperature under 50 t/cm$^2$ pressure. In this Example, the metal powder content of the green body after pressing was about 94 wt %.

Example 3a

Sintered compacts were produced in the same manner as in Example 1a, except that conditions for isostatic pressing (CIP) were changed into 22° C. temperature under 100 t/cm$^2$ pressure. In this Example, the metal powder content of the green body after pressing was about 94.1 wt %.

Example 4a

Sintered compacts were produced in the same manner as in Example 1a, except that sintering conditions during the sintering treatment were changed into 1250° C.×2.5 hours in an Ar gas atmosphere.

Example 5a

Sintered compacts were produced in the same manner as in Example 2a, except that sintering conditions during the sintering treatment were changed into 1250° C.×2.5 hours in an Ar gas atmosphere.

Example 6a

Sintered compacts were produced in the same manner as in Example 3a, except that sintering conditions during the sintering treatment were changed into 1250° C.×2.5 hours in an Ar gas atmosphere.

Comparative Example 1a

Sintered compacts were produced in the same manner as in Example 1a, except that isostatic pressing process for pressing the green bodies was omitted, and that sintering conditions during the sintering treatment were changed into 1350° C.×3.5 hours in an Ar gas atmosphere.

Example 7a

As for metal powder, Ti powder of 10 $\mu$m mean particle size was prepared by a gas atomization method.

A binder including 2.1 wt % of polystyrene (PS), 2.4 wt % of an ethylene-vinyl acetate copolymer (EVA) and 2.2 wt % of paraffin wax; and 1.3 wt % of dibutyl phthalate (plasticizer) were mixed with 92 wt % of the prepared metal powder. The mixture containing these components were compounded in a compounding machine under the conditions of 115° C.×1 hour.

Then, the obtained feed stock was pelletized and classified to produce pellets of 3 mm mean particle size. Using these pellets, metal injection molding (MIM) was performed with an injection molding machine to produce 200 cylindrical green bodies of 11.2 mm diameter×28 mm height (target dimensions after sintering treatment were 10 mm diameter× 25 mm height). Molding conditions during the injection molding were mold temperature of 30° C. and injection pressure of 110 kgf/cm$^2$.

The metal powder content of the produced green body was about 91.5 wt %.

Next, a coating film was formed on the surface of each green body in the same manner as in the above, and then the green bodies were set in the isostatic pressing machine described earlier and subjected to isostatic pressing (CIP). In this pressing process, conditions were 27° C. temperature, 15 t/cm$^2$ pressure. At this point, the metal powder content of the green body was about 91.8 wt %.

After the isostatic pressing, the green bodies were subjected to a debinding treatment in a debinding furnace. This debinding treatment was carried out under the conditions of reduced pressure of $1\times10^{-3}$ torr at a temperature of 280° C. for one hour, and then the temperature was raised to 450° C. and such condition was being kept for another one hour. The coating film on each green body was eliminated in the course of the debinding treatment.

Next, the binder removed green bodies which had been obtained through the debinding treatment were sintered in a sintering furnace to produce sintered compacts. Sintering conditions were 1150° C.×3 hours in an Ar gas atmosphere.

Example 8a

Sintered compacts were produced in the same manner as in Example 7a, except that conditions for isostatic pressing (CIP) were changed into 27° C. temperature under 40 t/cm$^2$ pressure. In this Example, the metal powder content of the green body after pressing was about 92 wt %.

Example 9a

Sintered compacts were produced in the same manner as in Example 7a, except that conditions for isostatic pressing (CIP) were changed into 27° C. temperature under 80 t/cm$^2$ pressure. In this Example, the metal powder content of the green body after pressing was about 92.1 wt %.

Example 10a

Sintered compacts were produced in the same manner as in Example 7a, except that sintering conditions during the sintering treatment were changed into 1100° C.×3 hours in an Ar gas atmosphere.

Example 11a

Sintered compacts were produced in the same manner as in Example 8a, except that sintering conditions during the sintering treatment were changed into 1100° C.×3 hours in an Ar gas atmosphere.

Example 12a

Sintered compacts were produced in the same manner as in Example 9a, except that sintering conditions during the sintering treatment were changed into 1150° C.×2.5 hours in an Ar gas atmosphere.

Comparative Example 2a

Sintered compacts were produced in the same manner as in Example 7a, except that isostatic pressing process for pressing the green bodies was omitted, and that sintering conditions during the sintering treatment were changed into 1220° C.×3.5 hours in an Ar gas atmosphere.

Example 13a

As for metal powder, W powder of 3 $\mu$m mean particle size, Ni powder of 2 $\mu$m mean particle size, and Cu powder of 12 $\mu$m mean particle size were respectively prepared by a reduction method.

A binder including 1.2 wt % of polystyrene (PS), 1.4 wt % of an ethylene-vinyl acetate copolymer (EVA) and 1.3 wt % of paraffin wax; and 0.6 wt % of dibutyl phthalate (plasticizer) were mixed with 92 wt % of the W powder, 2.5 wt % of the Ni powder, 1 wt % of the Cu powder. The mixture containing these components were compounded in a compounding machine under the conditions of 100° C.×1 hour.

Then, the obtained feed stock was pelletized and classified to produce pellets of 3 mm mean particle size. Using these pellets, metal injection molding (MIM) was performed with an injection molding machine to produce 200 cylindrical green bodies of 12.6 mm diameter×31.5 mm height (target dimensions after sintering treatment were 10 mm diameter×25 mm height). Molding conditions during the injection molding were mold temperature of 30° C. and injection pressure of 110 kgf/cm$^2$.

The total content of the metal powder (including the W, Ni and Cu powder) of the produced green body was about 95 wt %.

Next, a coating film was formed on the surface of each green body in the same manner as in the above, and then the green bodies were set in the isostatic pressing machine described earlier and subjected to isostatic pressing (CIP). In this pressing process, conditions were 27° C. temperature, 8 t/cm$^2$ pressure. At this point, the total content of the metal powder (including the W, Ni and Cu powder) of the produced green body was about 95.4 wt %.

After the isostatic pressing, the green bodies were subjected to a debinding treatment in a debinding furnace. This debinding treatment was carried out under the conditions of reduced pressure of $1\times10^{-3}$ torr at a temperature of 280° C. for one hour, and then the temperature was raised to 500° C. and such condition was being kept for another one hour. The coating film on each green body was eliminated in the course of the debinding treatment.

Next, the binder removed green bodies which had been obtained through the debinding treatment were sintered in a sintering furnace to produce sintered compacts. Sintering conditions were 1350° C.×3 hours in an Ar gas atmosphere.

Example 14a

Sintered compacts were produced in the same manner as in Example 13a, except that conditions for isostatic pressing (CIP) were changed into 27° C. temperature under 30 t/cm$^2$ pressure. In this Example, the total content of the metal powder (including the W, Ni and Cu powder) of the produced green body after pressing was about 95.5 wt %.

Example 15a

Sintered compacts were produced in the same manner as in Example 13a, except that conditions for isostatic pressing (CIP) were changed into 27° C. temperature under 80 t/cm$^2$ pressure. In this Example, the total content of the metal powder (including the W, Ni and Cu powder) of the produced green body after pressing was about 95.6 wt %.

Example 16a

Sintered compacts were produced in the same manner as in Example 13a, except that sintering conditions during the sintering treatment were changed into 1350° C.×2.5 hours in an Ar gas atmosphere.

Example 17a

Sintered compacts were produced in the same manner as in Example 14a, except that sintering conditions during the sintering treatment were changed into 1300° C.×3 hours in an Ar gas atmosphere.

Example 18a

Sintered compacts were produced in the same manner as in Example 15a, except that sintering conditions during the sintering treatment were changed into 1300° C.×2.5 hours in an Ar gas atmosphere.

Comparative Example 3a

Sintered compacts were produced in the same manner as in Example 13a, except that isostatic pressing process for pressing the green bodies was omitted, and that sintering conditions during the sintering treatment were changed into 1400° C.×3.5 hours in an Ar gas atmosphere.

<QUALITY/PROPERTIES EVALUATION>

The sintered compacts obtained in each of Examples 1a–18a and in each of Comparative Examples 1a–3a were cut along different cutting planes to observe visually the cutting planes thereof. In each observation, no sintering flaws and other flaws were found on the cutting plane of each sintered compact. Namely, through the observations, it was found that the sintered compacts obtained in each of Examples 1a–18a and in each of Comparative Examples 1a–3a had good quality.

Subsequently, each sintered compact was measured to determine relative density (which was represented from the equation "100-porosity" [%]) and tensile strength [N/mm$^2$]. Measurement results are given in the attached Tables 1 to 3.

As shown in each table, it has been found that the sintered compacts obtained in each of Examples 1a–18a can have higher density and improved mechanical strength under the sintering conditions of lower sintering temperatures and shorter sintering times as compared with the sintered compacts prepared in each of Comparative Examples 1a–3a of which green bodies were not pressurized.

Example 1b 200 sintered compacts were produced in the same manner as in Example 1a, except that a hole of 5.75 mmϕ diameter× 11.5 mm deep (target dimensions after sintering were 5 mmϕ diameter×10 mm depth) was formed in the center of each green body after pressing and prior to debinding.

Example 2b 200 sintered compacts were produced in the same manner as in Example 2a, except that a hole having the same dimensions as in Example 1b was formed in the center of each green body after pressing and prior to debinding.

Example 3b 200 sintered compacts were produced in the same manner as in Example 3a, except that a hole having the same dimensions as in Example 1b was formed in the center of each green body after pressing and prior to debinding.

Example 4b 200 sintered compacts were produced in the same manner as in Example 4a, except that a hole having the same dimensions as in Example 1b was formed in the center of each green body after pressing and prior to debinding.

Example 5b 200 sintered compacts were produced in the same manner as in Example 5a, except that a hole having the same dimensions as in Example 1b was formed in the center of each green body after pressing and prior to debinding.

Example 6b 200 sintered compacts were produced in the same manner as in Example 6a, except that a hole having the same dimensions as in Example 1b was formed in the center of each green body after pressing and prior to debinding.

Comparative Example 1b 200 sintered compacts were produced in the same manner as in Comparative Example 1a, except that a hole having the same dimensions as in Example 1b was formed in the center of each green body prior to debinding.

Example 7b 200 sintered compacts were produced in the same manner as in Example 7a, except that a hole of 5.6 mmϕ diameter× 11.2 mm deep (target dimensions after sintering were 5 mmϕ diameter×10 mm depth) was formed in the center of each green body after pressing and prior to debinding.

Example 8b 200 sintered compacts were produced in the same manner as in Example 8a, except that a hole having the same dimensions as in Example 7b was formed in the center of each green body after pressing and prior to debinding.

Example 9b 200 sintered compacts were produced in the same manner as in Example 9a, except that a hole having the same dimensions as in Example 7b was formed in the center of each green body after pressing and prior to debinding.

Example 10b 200 sintered compacts were produced in the same manner as in Example 10a, except that a hole having the same dimensions as in Example 7b was formed in the center of each green body after pressing and prior to debinding.

Example 11b 200 sintered compacts were produced in the same manner as in Example 11a, except that a hole having the same dimensions as in Example 7b was formed in the center of each green body after pressing and prior to debinding.

Example 12b 200 sintered compacts were produced in the same manner as in Example 12a, except that a hole having the same dimensions as in Example 7b was formed in the center of each green body after pressing and prior to debinding.

Comparative Example 2b 200 sintered compacts were produced in the same manner as in Comparative Example 2a, except that a hole having the same dimensions as in Example 7b was formed in the center of each green body prior to debinding.

Example 13b 200 sintered compacts were produced in the same manner as in Example 13a, except that a hole of 6.3 mmϕ diameter× 12.6 mm deep (target dimensions after sintering were 5 mmϕ diameter×10 mm depth) was formed in the center of each green body after pressing and prior to debinding.

Example 14b 200 sintered compacts were produced in the same manner as in Example 14a, except that a hole having the same dimensions as in Example 13b was formed in the center of each green body after pressing and prior to debinding.

Example 15b 200 sintered compacts were produced in the same manner as in Example 15a, except that a hole having the same dimensions as in Example 13b was formed in the center of each green body after pressing and prior to debinding.

Example 16b 200 sintered compacts were produced in the same manner as in Example 16a, except that a hole having the same dimensions as in Example 13b was formed in the center of each green body after pressing and prior to debinding.

Example 17b 200 sintered compacts were produced in the same manner as in Example 17a, except that a hole having the same dimensions as in Example 13b was formed in the center of each green body after pressing and prior to debinding.

Example 18b 200 sintered compacts were produced in the same manner as in Example 18a, except that a hole having the same dimensions as in Example 13b was formed in the center of each green body after pressing and prior to debinding.

Comparative Example 3b 200 sintered compacts were produced in the same manner as in Comparative Example 3a, except that a hole having the same dimensions as in Example 13b was formed in the center of each green body prior to debinding.

<QUALITY/PROPERTIES EVALUATION>

The sintered compacts obtained in each of Examples 1b–18b and in each of Comparative Examples 1b–3b were cut along different cutting planes to observe visually the cutting planes thereof. In each observation, no sintering flaws and other flaws were found on the cutting plane of each sintered compact. Namely, through the observations, it was found that the sintered compacts obtained in each of Examples 1b–18b and in each of Comparative Examples 1b–3b had good quality.

Subsequently, each sintered compact was measured to determine relative density (which was represented from the equation "100-porosity" [%]) and tensile strength [N/mm$^2$]. Measurement results are given in the attached Tables 4 to 6.

Further, dimensional error in diameter and height of each sintered compact (that is, error with respect to target dimensions: which is represented as average value for 200 compacts); and dimensional error in diameter and depth of the hole formed in each sintered compact (that is, error with respect to target dimensions: which is represented as average value for 200 sintered compacts) were measured. Measurement results are presented in the attached Tables 4 to 6, below.

As shown in each table, it has been found that the sintered compacts obtained in each of Examples 1b–18b can have higher density and improved mechanical strength under the sintering conditions of lower sintering temperatures and shorter sintering times as compared with the sintered compacts prepared in each of Comparative Examples 1b–3b of which green bodies were not pressurized.

Further, it has been also found that the sintered compacts prepared in each of Examples 1b–18b exhibit less dimensional error in the overall and in the hole and have high dimensional precision as compared with the sintered compacts prepared in each of Comparative Examples 1b–3b of which green bodies were not pressurized.

Example 1c

As for metal powder, a stainless steel (SUS 316/ composition: Fe-18Cr-12Ni-2.5Mo alloy) powder of 9 $\mu$m mean particle size was prepared by a water atomization method.

A binder including 1.9 wt % of polystyrene (PS), 1.8 wt % of an ethylene-vinyl acetate copolymer (EVA) and 1.5 wt % of paraffin wax; and 0.8 wt % of dibutyl phthalate (plasticizer) were mixed with 94 wt % of the prepared metal powder. The mixture containing these components were compounded in a compounding machine under the conditions of 115° C.×1 hour.

Then, the obtained feed stock was pelletized and classified to produce pellets of 3 mm mean particle size. Using these pellets, metal injection molding (MIM) was performed with an injection molding machine to produce 200 cylindrical green bodies of 11.5 mm diameter×28.7 mm height (target dimensions after sintering treatment were 10 mm diameter×25 mm height). Molding conditions during the injection molding were mold temperature of 30° C. and injection pressure of 110 kgf/cm$^2$.

The metal powder content of the produced green body was about 93.6 wt %.

Next, the produced green bodies were subjected to a debinding treatment in a debinding furnace. This debinding treatment was carried out under the conditions of reduced pressure of $1\times10^{-3}$ torr at a temperature of 300° C. for one hour, and then the temperature was raised to 500° C. and such condition was being kept for another one hour.

Next, an isoprene rubber coating film (thickness 0.3 mm) was formed on the surface of each green body after debinding in accordance with a dipping process. The green bodies coated with the coating film were set in an isostatic pressing machine (produced by Kabushiki Kaisha Kobe Seikosho) and then subjected to an isostatic pressing (CIP). In this process, conditions were 22° C. temperature, 6 t/cm$^2$ pressure.

After isostatic pressing, the green bodies were subjected to a sintering treatment in a sintering furnace. Sintering conditions were 1300° C.×3 hours in an Ar gas atmosphere.

The coating film on each green body was eliminated in the course of the sintering treatment.

Example 2c

Sintered compacts were produced in the same manner as in Example 1c, except that conditions for isostatic pressing (CIP) were changed into 22° C. temperature under 50 t/cm$^2$ pressure.

Example 3c

Sintered compacts were produced in the same manner as in Example 1c, except that conditions for isostatic pressing (CIP) were changed into 22° C. temperature under 100 t/cm$^2$ pressure.

Example 4c

Sintered compacts were produced in the same manner as in Example 1c, except that sintering conditions during the sintering treatment were changed into 1250° C.×2.5 hours in an Ar gas atmosphere.

Example 5c

Sintered compacts were produced in the same manner as in Example 2c, except that sintering conditions during the sintering treatment were changed into 1250° C.×2.5 hours in an Ar gas atmosphere.

Example 6c

Sintered compacts were produced in the same manner as in Example 3c, except that sintering conditions during the sintering treatment were changed into 1250° C.×2.5 hours in an Ar gas atmosphere.

Comparative Example 1c

Sintered compacts were produced in the same manner as in Example 1c, except that isostatic pressing process for pressing the green bodies was omitted, and that sintering conditions during the sintering treatment were changed into 1350° C.×3.5 hours in an Ar gas atmosphere.

Example 7c

As for metal powder, Ti powder of 6 $\mu$m mean particle size was prepared by a gas atomization method.

A binder including 2.1 wt % of polystyrene (PS), 2.4 wt % of an ethylene-vinyl acetate copolymer (EVA) and 2.2 wt % of paraffin wax; and 1.3 wt % of dibutyl phthalate (plasticizer) were mixed with 92 wt % of the prepared metal powder. The mixture containing these components were compounded in a compounding machine under the conditions of 115° C.×1 hour.

Then, the obtained feed stock was pelletized and classified to produce pellets of 3 mm mean particle size. Using these pellets, metal injection molding (MIM) was performed with an injection molding machine to produce 200 cylindrical green bodies of 11.2 mm diameter×28 mm height (target dimensions after sintering treatment were 10 mm diameter× 25 mm height). Molding conditions during the injection molding were mold temperature of 30° C. and injection pressure of 110 kgf/cm$^2$.

The metal powder content of the produced green body was about 91.5 wt %.

Next, the produced green bodies were subjected to a debinding treatment in a debinding furnace. This debinding treatment was carried out under the conditions of reduced pressure of $1\times10^{-3}$ torr at a temperature of 290° C. for one hour, and then the temperature was raised to 450° C. and such condition was being kept for another one hour.

Next, a coating film was formed on the surface of each green body after debinding in the same manner as in the above, and then the green bodies were set in the isostatic pressing machine described earlier and subjected to isostatic pressing (CIP). Pressing conditions were 27° C. temperature and 15 t/cm$^2$ pressure.

After the isostatic pressing, the green bodies were sintered in a sintering furnace to produce sintered compacts. Sintering conditions were 1150° C.×3 hours in an Ar gas atmosphere.

The coating film was eliminated in the course of the sintering process.

Example 8c

Sintered compacts were produced in the same manner as in Example 7c, except that conditions for isostatic pressing (CIP) were changed into 27° C. temperature under 40 t/cm$^2$ pressure.

Example 9c

Sintered compacts were produced in the same manner as in Example 7c, except that conditions for isostatic pressing (CIP) were changed into 27° C. temperature under 80 t/cm$^2$ pressure.

Example 10c

Sintered compacts were produced in the same manner as in Example 7c, except that sintering conditions during the sintering treatment were changed into 1100° C.×3 hours in an Ar gas atmosphere.

Example 11c

Sintered compacts were produced in the same manner as in Example 8c, except that sintering conditions during the sintering treatment were changed into 1100° C.×3 hours in an Ar gas atmosphere.

Example 12c

Sintered compacts were produced in the same manner as in Example 9c, except that sintering conditions during the sintering treatment were changed into 1150° C.×2.5 hours in an Ar gas atmosphere.

Comparative Example 2c

Sintered compacts were produced in the same manner as in Example 7c, except that isostatic pressing process for pressing the green bodies was omitted, and that sintering conditions during the sintering treatment were changed into 1220° C.×3.5 hours in an Ar gas atmosphere.

Example 13c

As for metal powder, W powder of 3 μm mean particle size, Ni powder of 2 μm mean particle size, and Cu powder of 12 μm mean particle size were respectively prepared by a reduction method.

A binder including 1.2 wt % of polystyrene (PS), 1.4 wt % of an ethylene-vinyl acetate copolymer (EVA) and 1.3 wt % of paraffin wax; and 0.6 wt % of dibutyl phthalate (plasticizer) were mixed with 92 wt % of the W powder, 2.5 wt % of the Ni powder, 1 wt % of the Cu powder. The mixture containing these components were compounded in a compounding machine under the conditions of 100° C.×1 hour.

Then, the obtained feed stock was pelletized and classified to produce pellets of 3 mm mean particle size. Using these pellets, metal injection molding (MIM) was performed with an injection molding machine to produce 200 cylindrical green bodies of 12.6 mm diameter×31.5 mm height (target dimensions after sintering treatment were 10 mm diameter×25 mm height). Molding conditions during the injection molding were mold temperature of 30° C. and injection pressure of 110 kgf/cm$^2$.

The total content of the metal powder (including the W, Ni and Cu powder) of the produced green body was about 95 wt %.

Next, the produced green bodies were subjected to a debinding treatment in a debinding furnace. This debinding treatment was carried out under the conditions of reduced pressure of $1\times10^{-3}$ torr at a temperature of 280° C. for one hour, and then the temperature was raised to 500° C. and such condition was being kept for 1.5 hours.

Next, a coating film was formed on the surface of each green body after debinding in the same manner as in the above, and then the green bodies were set in the isostatic pressing machine described earlier and subjected to isostatic pressing (CIP). Pressing conditions were 35° C. temperature and 8 t/cm$^2$ pressure.

After the isostatic pressing, the green bodies were sintered in a sintering furnace to produce sintered compacts. Sintering conditions were 1350° C.×3 hours in an Ar gas atmosphere.

The coating film was eliminated in the course of the sintering process.

Example 14c

Sintered compacts were produced in the same manner as in Example 13c, except that conditions for isostatic pressing (CIP) were changed into 35° C. temperature under 30 t/cm$^2$ pressure.

Example 15c

Sintered compacts were produced in the same manner as in Example 13c, except that conditions for isostatic pressing (CIP) were changed into 35° C. temperature under 65 t/cm$^2$ pressure.

Example 16c

Sintered compacts were produced in the same manner as in Example 13c, except that sintering conditions during the sintering treatment were changed into 1350° C.×2.5 hours in an Ar gas atmosphere.

Example 17c

Sintered compacts were produced in the same manner as in Example 14c, except that sintering conditions during the sintering treatment were changed into 1300° C.×3 hours in an Ar gas atmosphere.

Example 18c

Sintered compacts were produced in the same manner as in Example 15c, except that sintering conditions during the sintering treatment were changed into 1300° C.×2.5 hours in an Ar gas atmosphere.

Comparative Example 3c

Sintered compacts were produced in the same manner as in Example 13c, except that isostatic pressing process for pressing the green bodies was omitted, and that sintering conditions during the sintering treatment were changed into 1400° C.×3.5 hours in an Ar gas atmosphere.

<QUALITY/PROPERTIES EVALUATION>

The sintered compacts obtained in each of Examples 1c–18c and in each of Comparative Examples 1c–3c were cut along different cutting planes to observe visually the cutting planes thereof. In each observation, no sintering flaws and other flaws were found on the cutting plane of each sintered compact. Namely, through the observations, it was found that the sintered compacts obtained in each of Examples 1c–18c and in each of Comparative Examples 1c–3c had good quality.

Subsequently, each sintered compact was measured to determine relative density (which was represented from the equation "100-porosity" [%]) and tensile strength [N/mm$^2$]. Measurement results are given in the attached Tables 7 to 9.

As shown in each table, it has been found that the sintered compacts obtained in each of Examples 1c–18c can have higher density and improved mechanical strength under the sintering conditions of lower sintering temperatures and shorter sintering times as compared with the sintered compacts prepared in each of Comparative Examples 1c–3c of which green bodies were not pressurized.

Example 1d 200 green bodies were produced by metal injection molding (MIM) in the same manner as in Example 1c, except that a stainless steel (SUS 316) powder of 10 $\mu$m mean particle size produced by a gas atomization method was used as the metal powder. In this Example, the metal powder content of the green body was about 93.6 wt %.

Next, the obtained green bodies were subjected to a first debinding treatment (intermediate debinding treatment) in a debinding furnace. Debinding conditions were 280° C.×1 hour under $1\times10^{-3}$ torr reduced pressure.

After the intermediate debinding, the green bodies were subjected to isostatic pressing (CIP) in accordance the same manner and under the same conditions as in Example 1c.

Next, the pressurized green bodies were subjected to a second debinding treatment (final debinding treatment) in a debinding furnace. Debinding conditions were 500° C.×1 hour under $1\times10^{-3}$ torr reduced pressure. The coating film on each green body was eliminated in the course of the final debinding process.

Next, the binder removed green bodies which had been obtained through the debinding treatment were sintered in a sintering furnace to produce sintered compacts. Sintering conditions were 1300° C.×3 hours in an Ar gas atmosphere.

Example 2d

Sintered compacts were produced in the same manner as in Example 1d, except that conditions for isostatic pressing (CIP) were changed into 22° C. temperature under 50 t/cm$^2$ pressure.

Example 3d

Sintered compacts were produced in the same manner as in Example 1d, except that conditions for isostatic pressing (CIP) were changed into 22° C. temperature under 100 t/cm$^2$ pressure.

Example 4d

Sintered compacts were produced in the same manner as in Example 1d, except that sintering conditions during the sintering treatment were changed into 1250° C.×2.5 hours in an Ar gas atmosphere.

Example 5d

Sintered compacts were produced in the same manner as in Example 2d, except that sintering conditions during the sintering treatment were changed into 1250° C.×2.5 hours in an Ar gas atmosphere.

Example 6d

Sintered compacts were produced in the same manner as in Example 3d, except that sintering conditions during the sintering treatment were changed into 1250° C.×2.5 hours in an Ar gas atmosphere.

Comparative Example 1d

Sintered compacts were produced in the same manner as in Example 1d, except that isostatic pressing process for pressing the green bodies was omitted (during this time, the green bodies were left for one hour at ambient temperature), and that sintering conditions during the sintering treatment were changed into 1350° C.×3.5 hours in an Ar gas atmosphere.

Example 7d 200 green bodies were produced by metal injection molding (MIM) in the same manner as in Example 7c, except that Ti powder of 8 $\mu$m mean particle size produced by a gas atomization method was used as the metal powder. In this Example, the metal powder content of the green body was about 91.6 wt %.

Next, the obtained green bodies were subjected to a first debinding treatment (intermediate debinding treatment) in a debinding furnace. Debinding conditions were 280° C.×1 hour under $1\times10^{-3}$ torr reduced pressure.

After the intermediate debinding, the green bodies were subjected to isostatic pressing (CIP) in accordance the same manner and under the same conditions as in Example 7c.

Next, the pressurized green bodies were subjected to a second debinding treatment (final debinding treatment) in a debinding furnace. Debinding conditions were 440° C.×1 hour under $1\times10^{-3}$ torr reduced pressure. The coating film on each green body was eliminated in the course of the final debinding process.

Next, the binder removed green bodies which had been obtained through the debinding treatment were sintered in a sintering furnace to produce sintered compacts. Sintering conditions were 1150° C.×3 hours in an Ar gas atmosphere.

Example 8d

Sintered compacts were produced in the same manner as in Example 7d, except that conditions for isostatic pressing (CIP) were changed into 27° C. temperature under 40 t/cm$^2$ pressure.

Example 9d

Sintered compacts were produced in the same manner as in Example 7d, except that conditions for isostatic pressing (CIP) were changed into 27° C. temperature under 80 t/cm$^2$ pressure.

Example 10d

Sintered compacts were produced in the same manner as in Example 7d, except that sintering conditions during the sintering treatment were changed into 1100° C.×3 hours in an Ar gas atmosphere.

Example 11d

Sintered compacts were produced in the same manner as in Example 8d, except that sintering conditions during the sintering treatment were changed into 1100° C.×3 hours in an Ar gas atmosphere.

Example 12d

Sintered compacts were produced in the same manner as in Example 9d, except that sintering conditions during the sintering treatment were changed into 1150° C.×2.5 hours in an Ar gas atmosphere.

Comparative Example 2d

Sintered compacts were produced in the same manner as in Example 7d, except that isostatic pressing process for pressing the green bodies was omitted (during this time, the green bodies were left for one hour at ambient temperature), and that sintering conditions during the sintering treatment were changed into 1220° C.×3.5 hours in an Ar gas atmosphere.

Example 13d 200 green bodies were produced by metal injection molding (MIM) in the same manner as in Example 13c, except that a mixture of W powder of 4 $\mu$m mean particle size, Ni powder of 2 $\mu$m mean particle size, and Cu powder of 15 $\mu$m mean particle size which had been respectively produced by a reduction method was used as the metal powder. In this Example, the total content of the metal powder (including the W, Ni and Cu powder) of the produced green body was about 95.1 wt %.

Next, the obtained green bodies were subjected to a first debinding treatment (intermediate debinding treatment) in a debinding furnace. Debinding conditions were 280° C.×1 hour under $1\times10^{-3}$ torr reduced pressure.

After the intermediate debinding, the green bodies were subjected to isostatic pressing (CIP) in accordance the same manner and under the same conditions as in Example 13c.

Next, the pressurized green bodies were subjected to a second debinding treatment (final debinding treatment) in a debinding furnace. Debinding conditions during the second debinding treatment were 480° C.×1.2 hours under $1\times10^{-3}$ torr reduced pressure. The coating film on each green body was eliminated in the course of the final debinding process.

Next, the pressurized green bodies were sintered in a sintering furnace to produce sintered compacts. Sintering conditions were 1350° C.×3 hours in an Ar gas atmosphere.

Example 14d

Sintered compacts were produced in the same manner as in Example 13d, except that conditions for isostatic pressing (CIP) were changed into 35° C. temperature under 30 t/cm$^2$ pressure.

Example 15d

Sintered compacts were produced in the same manner as in Example 13d, except that conditions for isostatic pressing (CIP) were changed into 35° C. temperature under 65 t/cm$^2$ pressure.

Example 16d

Sintered compacts were produced in the same manner as in Example 13d, except that sintering conditions during the sintering treatment were changed into 1350° C.×2.5 hours in an Ar gas atmosphere.

Example 17d

Sintered compacts were produced in the same manner as in Example 14d, except that sintering conditions during the sintering treatment were changed into 1300° C.×3 hours in an Ar gas atmosphere.

Example 18d

Sintered compacts were produced in the same manner as in Example 15d, except that sintering conditions during the sintering treatment were changed into 1300° C.×2.5 hours in an Ar gas atmosphere.

Comparative Example 3d

Sintered compacts were produced in the same manner as in Example 13d, except that isostatic pressing process for pressing the green bodies was omitted (during this time, the green bodies were left for one hour at ambient temperature), and that sintering conditions during the sintering treatment were changed into 1400° C.×3.5 hours in an Ar gas atmosphere.

<QUALITY/PROPERTIES EVALUATION>

The sintered compacts obtained in each of Examples 1d–18d and in each of Comparative Examples 1d–3d were cut along different cutting planes to observe visually the cutting planes thereof. In each observation, no sintering flaws and other flaws were found on the cutting plane of each sintered compact. Namely, through the observations, it was found that the sintered compacts obtained in each of Examples 1d–18d and in each of Comparative Examples 1d–3d had good quality.

Subsequently, each sintered compact was measured to determine relative density (which was represented from the equation "100-porosity" [%]) and tensile strength [N/mm$^2$]. Measurement results are given in the attached Tables 10 to 12.

As shown in each table, it has been found that the sintered compacts obtained in each of Examples 1d–18d can have higher density and improved mechanical strength under the sintering conditions of lower sintering temperatures and shorter sintering times as compared with the sintered compacts prepared in each of Comparative Examples 1d–3d of which green bodies were not pressurized.

Example 1e 200 sintered compacts were produced in the same manner as in Example 1c, except that a hole of 5.3 mmϕ diameter× 10.6 mm deep (target dimensions after sintering were 5 mmϕ diameter×10 mm depth) was formed in the center of each green body after pressing.

Example 2e 200 sintered compacts were produced in the same manner as in Example 2c, except that a hole having the same dimensions as in Example 1e was formed in the center of each green body after pressing.

Example 3e 200 sintered compacts were produced in the same manner as in Example 3c, except that a hole having the same dimensions as in Example 1e was formed in the center of each green body after pressing.

Example 4e 200 sintered compacts were produced in the same manner as in Example 4c, except that a hole having the same dimensions as in Example 1e was formed in the center of each green body after pressing.

Example 5e 200 sintered compacts were produced in the same manner as in Example 5c, except that a hole having the same dimensions as in Example 1e was formed in the center of each green body after pressing.

Example 6e 200 sintered compacts were produced in the same manner as in Example 6c, except that a hole having the same dimensions as in Example 1e was formed in the center of each green body after pressing.

Comparative Example 1e 200 sintered compacts were produced in the same manner as in Comparative Example 1c, except that a hole of 5.75 mmϕ diameter×11.5 mm deep (target dimensions after sintering were 5 mmϕ diameter×10 mm depth) was formed in the center of each green body prior to debinding.

Example 7e 200 sintered compacts were produced in the same manner as in Example 7c, except that a hole of 5.3 mmϕ diameter× 10.6 mm deep (target dimensions after sintering were 5 mmϕ diameter×10 mm depth) was formed in the center of each green body after pressing.

Example 8e 200 sintered compacts were produced in the same manner as in Example 8c, except that a hole having the same dimensions as in Example 7e was formed in the center of each green body after pressing.

Example 9e 200 sintered compacts were produced in the same manner as in Example 9c, except that a hole having the same dimensions as in Example 7e was formed in the center of each green body after pressing.

Example 10e 200 sintered compacts were produced in the same manner as in Example 10c, except that a hole having the same dimensions as in Example 7e was formed in the center of each green body after pressing.

Example 11e 200 sintered compacts were produced in the same manner as in Example 11c, except that a hole having the same dimensions as in Example 7e was formed in the center of each green body after pressing.

Example 12e 200 sintered compacts were produced in the same manner as in Example 12c, except that a hole having the same dimensions as in Example 7e was formed in the center of each green body after pressing.

Comparative Example 2e 200 sintered compacts were produced in the same manner as in Comparative Example 2c, except that a hole of 5.6 mmϕ diameter×11.2 mm deep (target dimensions after sintering were 5 mmϕ diameter×10 mm depth) was formed in the center of each green body prior to debinding.

Example 13e 200 sintered compacts were produced in the same manner as in Example 13c, except that a hole of 5.3 mmϕ diameter× 10.6 mm deep (target dimensions after sintering were 5 mmϕ diameter×10 mm depth) was formed in the center of each green body after pressing.

Example 14e 200 sintered compacts were produced in the same manner as in Example 14c, except that a hole having the same dimensions as in Example 13e was formed in the center of each green body after pressing.

Example 15e 200 sintered compacts were produced in the same manner as in Example 15c, except that a hole having the same dimensions as in Example 13e was formed in the center of each green body after pressing.

Example 16e 200 sintered compacts were produced in the same manner as in Example 16c, except that a hole having the same dimensions as in Example 13e was formed in the center of each green body after pressing.

Example 17e 200 sintered compacts were produced in the same manner as in Example 17c, except that a hole having the same dimensions as in Example 13e was formed in the center of each green body after pressing.

Example 18e 200 sintered compacts were produced in the same manner as in Example 18c, except that a hole having the same dimensions as in Example 13e was formed in the center of each green body after pressing.

Comparative Example 3e 200 sintered compacts were produced in the same manner as in Comparative Example 3c, except that a hole of 6.3 mmϕ diameter×12.6 mm deep (target dimensions after sintering were 5 mmϕ diameter×10 mm depth) was formed in the center of each green body prior to debinding.

<QUALITY/PROPERTIES EVALUATION>

The sintered compacts obtained in each of Examples 1e–18e and in each of Comparative Examples 1e–3e were cut along different cutting planes to observe visually the cutting planes thereof. In each observation, no sintering flaws and other flaws were found on the cutting plane of each sintered compact. Namely, through the observations, it was found that the sintered compacts obtained in each of Examples 1e–18e and in each of Comparative Examples 1e–3e had good quality.

Subsequently, each sintered compact was measured to determine relative density (which was represented from the equation "100-porosity" [%]) and tensile strength [N/mm$^2$]. Measurement results are given in the attached Tables 13 to 15.

Further, dimensional error in diameter and height of each sintered compact (that is, error with respect to target dimensions: which is represented as average value for 200 compacts); and dimensional error in diameter and depth of the hole formed in each sintered compact (that is, error with respect to target dimensions: which is represented as average value for 200 sintered compacts) were measured. Measurement results are presented in the attached Tables 13 to 15.

As shown in each table, it has been found that the sintered compacts obtained in each of Examples 1e–18e can have higher density and improved mechanical strength under the sintering conditions of lower sintering temperatures and shorter sintering times as compared with the sintered compacts prepared in each of Comparative Examples 1e–3e of which green bodies were not pressurized.

Further, it has been also found that the sintered compacts prepared in each of Examples 1e–18e exhibit less dimensional error in the overall and in the hole and have high dimensional precision as compared with the sintered compacts prepared in each of Comparative Examples 1e–3e of which green bodies were not pressurized.

Example 1f 200 sintered compacts were produced in the same manner as in Example 1d, except that a hole of 5.4 mmϕ diameter×10.8 mm deep (target dimensions after sintering were 5 mmϕ diameter×10 mm depth) was formed in the center of each green body after pressing.

Example 2f 200 sintered compacts were produced in the same manner as in Example 2d, except that a hole having the same dimensions as in Example 1f was formed in the center of each green body after pressing.

Example 3f 200 sintered compacts were produced in the same manner as in Example 3d, except that a hole having the same dimensions as in Example 1f was formed in the center of each green body after pressing.

Example 4f 200 sintered compacts were produced in the same manner as in Example 4d, except that a hole having the same dimensions as in Example 1f was formed in the center of each green body after pressing.

Example 5f 200 sintered compacts were produced in the same manner as in Example 5d, except that a hole having the same dimensions as in Example 1f was formed in the center of each green body after pressing.

Example 6f 200 sintered compacts were produced in the same manner as in Example 6d, except that a hole having the same dimensions as in Example 1f was formed in the center of each green body after pressing.

Comparative Example 1f 200 sintered compacts were produced in the same manner as in Comparative Example 1d, except that a hole of 5.75 mmϕ diameter×11.5 mm deep (target dimensions after sintering were 5 mmϕ diameter×10 mm depth) was formed in the center of each green body prior to intermediate debinding.

Example 7f 200 sintered compacts were produced in the same manner as in Example 7d, except that a hole of 5.3 mmϕ diameter×10.6 mm deep (target dimensions after sintering were 5 mmϕ diameter×10 mm depth) was formed in the center of each green body after pressing.

Example 8f 200 sintered compacts were produced in the same manner as in Example 8d, except that a hole having the same dimensions as in Example 7f was formed in the center of each green body after pressing.

Example 9f 200 sintered compacts were produced in the same manner as in Example 9d, except that a hole having the same dimensions as in Example 7f was formed in the center of each green body after pressing.

Example 10f 200 sintered compacts were produced in the same manner as in Example 10d, except that a hole having the same dimensions as in Example 7f was formed in the center of each green body after pressing.

Example 11f 200 sintered compacts were produced in the same manner as in Example 11d, except that a hole having the same dimensions as in Example 7f was formed in the center of each green body after pressing.

Example 12f 200 sintered compacts were produced in the same manner as in Example 12d, except that a hole having the same dimensions as in Example 7f was formed in the center of each green body after pressing.

Comparative Example 2f 200 sintered compacts were produced in the same manner as in Comparative Example 2d, except that a hole of 5.6 mmϕ diameter×11.2 mm deep (target dimensions after sintering were 5 mmϕ diameter×10 mm depth) was formed in the center of each green body prior to intermediate debinding.

Example 13f 200 sintered compacts were produced in the same manner as in Example 13d, except that a hole of 5.7 mmϕ diameter×11.4 mm deep (target dimensions after sintering were 5 mmϕ diameter×10 mm depth) was formed in the center of each green body after pressing.

Example 14f 200 sintered compacts were produced in the same manner as in Example 14d, except that a hole having the same dimensions as in Example 13f was formed in the center of each green body after pressing.

Example 15f 200 sintered compacts were produced in the same manner as in Example 15d, except that a hole having the same dimensions as in Example 13f was formed in the center of each green body after pressing.

Example 16f 200 sintered compacts were produced in the same manner as in Example 16d, except that a hole having the same dimensions as in Example 13f was formed in the center of each green body after pressing.

Example 17f 200 sintered compacts were produced in the same manner as in Example 17d, except that a hole having the same dimensions as in Example 13f was formed in the center of each green body after pressing.

Example 18f 200 sintered compacts were produced in the same manner as in Example 18d, except that a hole having the same dimensions as in Example 13f was formed in the center of each green body after pressing.

Comparative Example 3f 200 sintered compacts were produced in the same manner as in Comparative Example 3d, except that a hole of 6.3 mmϕ diameter×12.6 mm deep (target dimensions after sintering were 5 mmϕ diameter×10 mm depth) was formed in the center of each green body prior to intermediate debinding.

<QUALITY/PROPERTIES EVALUATION>

The sintered compacts obtained in each of Examples 1f–18f and in each of Comparative Examples 1f–3f were cut along different cutting planes to observe visually the cutting planes thereof. In each observation, no sintering flaws and other flaws were found on the cutting plane of each sintered compact. Namely, through the observations, it was found that the sintered compacts obtained in each of Examples 1f–18f and in each of Comparative Examples 1f–3f had good quality.

Subsequently, each sintered compact was measured to determine relative density (which was represented from the equation "100-porosity" [%]) and tensile strength [N/mm$^2$]. Measurement results are given in the attached Tables 16 to 18.

Further, dimensional error in diameter and height of each sintered compact (that is, error with respect to target dimensions: which is represented as average value for 200 compacts); and dimensional error in diameter and depth of the hole formed in each sintered compact (that is, error with respect to target dimensions: which is represented as average value for 200 sintered compacts) were measured. Measurement results are presented in the attached Tables 16 to 18.

As shown in each table, it has been found that the sintered compacts obtained in each of Examples 1f–18f can have higher density and improved mechanical strength under the sintering conditions of lower sintering temperatures and shorter sintering times as compared with the sintered compacts prepared in each of Comparative Examples 1f–3f of which green bodies were not pressurized.

Further, it has been also found that the sintered compacts prepared in each of Examples 1f–18f exhibit less dimensional error in the overall and in the hole and have high dimensional precision as compared with the sintered compacts prepared in each of Comparative Examples 1f–3f of which green bodies were not pressurized.

Example 1g

As for metal powder, a stainless steel (SUS 316/composition: Fe-18Cr-12Ni-2.5Mo alloy) powder of 9 $\mu$m mean particle size was prepared by a gas atomization method.

A binder including 1.9 wt % of polystyrene (PS), 1.8 wt % of an ethylene-vinyl acetate copolymer (EVA) and 1.5 wt % of paraffin wax; and 0.8 wt % of dibutyl phthalate (plasticizer) were mixed with 94 wt % of the prepared metal powder. The mixture containing these components were compounded in a compounding machine under the conditions of 115° C.×1 hour.

Then, the obtained feed stock was pelletized and classified to produce pellets of 3 mm mean particle size. Using these pellets, metal injection molding (MIM) was performed with an injection molding machine to produce 200 cylindrical green bodies of 11.5 mm diameter×28.7 mm height (target dimensions after sintering treatment were 10 mm diameter×25 mm height). Molding conditions during the injection molding were mold temperature of 30° C. and injection pressure of 110 kgf/cm$^2$.

The metal powder content of the produced green body was about 93.6 wt %.

Next, the produced green bodies were subjected to a debinding treatment in a debinding furnace. This debinding treatment was carried out under the conditions of reduced pressure of $1\times10^{-3}$ torr at a temperature of 300° C. for one hour, and then the temperature was raised to 500° C. and such condition was being kept for another one hour.

Next, the binder removed green bodies which had been obtained through the debinding treatment were sintered in a sintering furnace to effect presintering in order to produce presintered compacts. Sintering conditions during the presintering treatment were 1050° C.×1 hour under $1\times10^{-3}$ torr reduced pressure.

Next, the produced presintered compact was cooled to ambient temperature, and then an isoprene rubber coating film (thickness 0.3 mm) was formed on the surface of each presintered compact in accordance with a dipping process. The presintered compacts coated with the coating film were set in an isostatic pressing machine (produced by Kabushiki Kaisha Kobe Seikosho) and then subjected to an isostatic pressing (CIP). In this process, conditions were 22° C. temperature, 6 t/cm$^2$ pressure.

Next, the presintered compacts after the pressing were sintered in a sintering furnace to effect main sintering (final sintering) in order to produce sintered compacts. Sintering conditions during the main sintering were 1300° C.×2 hours in an Ar gas atmosphere.

The coating film on each green body was eliminated in the course of the sintering treatment.

Example 2g

Sintered compacts were produced in the same manner as in Example 1g, except that conditions for isostatic pressing (CIP) were changed into 22° C. temperature under 50 t/cm$^2$ pressure.

Example 3g

Sintered compacts were produced in the same manner as in Example 1g, except that conditions for isostatic pressing (CIP) were changed into 22° C. temperature under 100 t/cm$^2$ pressure.

Example 4g

Sintered compacts were produced in the same manner as in Example 1g, except that sintering conditions during the presintering treatment were changed into 1100° C.×1 hour under 1×10$^{-3}$ torr reduced pressure.

Example 5g

Sintered compacts were produced in the same manner as in Example 2g, except that sintering conditions during the main sintering treatment were changed into 1250° C.×2 hours in an Ar gas atmosphere.

Example 6g

Sintered compacts were produced in the same manner as in Example 3g, except that sintering conditions during the presintering treatment were changed into 1130° C.×1 hour in an Ar gas atmosphere and that sintering conditions during the main sintering treatment were changed into 1300° C.×1.5 hours in an Ar gas atmosphere.

Comparative Example 1g

Sintered compacts were produced in the same manner as in Example 1g, except that isostatic pressing process for pressing the presintered compacts was omitted, and that sintering conditions during the main sintering treatment were changed into 1350° C.×2.5 hours in an Ar gas atmosphere. In this regard, the presintering and the main sintering were continuously conducted.

Example 7g

As for metal powder, Ti powder of 6 $\mu$m mean particle size was prepared by a gas atomization method.

A binder including 2.1 wt % of polystyrene (PS), 2.4 wt % of an ethylene-vinyl acetate copolymer (EVA) and 2.2 wt % of paraffin wax; and 1.3 wt % of dibutyl phthalate (plasticizer) were mixed with 92 wt % of the prepared metal powder. The mixture containing these components were compounded in a compounding machine under the conditions of 115° C.×1 hour.

Then, the obtained feed stock was pelletized and classified to produce pellets of 3 mm mean particle size. Using these pellets, metal injection molding (MIM) was performed with an injection molding machine to produce 200 cylindrical green bodies of 11.2 mm diameter×28 mm height (target dimensions after sintering treatment were 10 mm diameter×25 mm height). Molding conditions during the injection molding were mold temperature of 30° C. and injection pressure of 110 kgf/cm$^2$.

The metal powder content of the produced green body was about 91.5 wt %.

Next, the produced green bodies were subjected to a debinding treatment in a debinding furnace. This debinding treatment was carried out under the conditions of reduced pressure of 1×10$^{-3}$ torr at a temperature of 290° C. for one hour, and then the temperature was raised to 450° C. and such condition was being kept for another one hour.

Next, the binder removed green bodies which had been obtained through the debinding treatment were sintered in a sintering furnace to effect presintering in order to produce presintered compacts. Sintering conditions during the presintering treatment were 1000° C.×1 hour under 1×10$^{-3}$ torr reduced pressure.

Next, after cooling the produced presintered compact to ambient temperature, a coating film was formed on the surface of each presintered compact in the same manner as in the above, and then the presintered compacts were set in the isostatic pressing machine described earlier and subjected to isostatic pressing (CIP). In this pressing process, conditions were 27° C. temperature, 15 t/cm$^2$ pressure.

Next, the presintered compacts after the pressing were sintered in a sintering furnace to effect main sintering (final sintering) in order to produce sintered compacts. Sintering conditions during the main sintering were 1150° C.×2 hours in an Ar gas atmosphere.

The coating film on each green body was eliminated in the course of the main sintering treatment.

Example 8g

Sintered compacts were produced in the same manner as in Example 7g, except that conditions for isostatic pressing (CIP) were changed into 27° C. temperature under 40 t/cm$^2$ pressure.

Example 9g

Sintered compacts were produced in the same manner as in Example 7g, except that conditions for isostatic pressing (CIP) were changed into 27° C. temperature under 80 t/cm$^2$ pressure.

Example 10g

Sintered compacts were produced in the same manner as in Example 7g, except that sintering conditions during the presintering treatment were changed into 1080° C.×0.8 hours under 1×10$^{-3}$ torr reduced pressure.

Example 11g

Sintered compacts were produced in the same manner as in Example 8g, except that sintering conditions during the main sintering treatment were changed into 1100° C.×2 hours in an Ar gas atmosphere.

Example 12g

Sintered compacts were produced in the same manner as in Example 9g, except that sintering conditions during the presintering treatment were changed into 1050° C.×1 hour in an Ar gas atmosphere, and that sintering conditions during the main sintering treatment were changed into 1200° C.×1.5 hours in an Ar gas atmosphere.

Comparative Example 2g

Sintered compacts were produced in the same manner as in Example 7g, except that isostatic pressing process for pressing the presintered compacts was omitted, and that sintering conditions during the main sintering treatment were changed into 1220° C.×2.5 hours in an Ar gas atmosphere. In this regard, the presintering and the main sintering were continuously conducted.

Example 13g

As for metal powder, W powder of 3 μm mean particle size, Ni powder of 2 μm mean particle size, and Cu powder of 12 μm mean particle size were respectively prepared by a reduction method.

A binder including 1.2 wt % of polystyrene (PS), 1.4 wt % of an ethylene-vinyl acetate copolymer (EVA) and 1.3 wt % of paraffin wax; and 0.6 wt % of dibutyl phthalate (plasticizer) were mixed with 92 wt % of the W powder, 2.5 wt % of the Ni powder, 1 wt % of the Cu powder. The mixture containing these components were compounded in a compounding machine under the conditions of 100° C.×1 hour.

Then, the obtained feed stock was pelletized and classified to produce pellets of 3 mm mean particle size. Using these pellets, metal injection molding (MIM) was performed with an injection molding machine to produce 200 cylindrical green bodies of 12.6 mm diameter×31.5 mm height (target dimensions after sintering treatment were 10 mm diameter×25 mm height). Molding conditions during the injection molding were mold temperature of 30° C. and injection pressure of 110 kgf/cm$^2$.

The total content of the metal powder (including the W, Ni and Cu powder) of the produced green body was about 95 wt %.

Next, the produced green bodies were subjected to a debinding treatment in a debinding furnace. This debinding treatment was carried out under the conditions of reduced pressure of $1\times10^{-3}$ torr at a temperature of 280° C. for one hour, and then the temperature was raised to 500° C. and such condition was being kept for 1.5 hours.

Next, the binder removed green bodies which had been obtained through the debinding treatment were sintered in a sintering furnace to effect presintering in order to produce presintered compacts. Sintering conditions during the presintering treatment were 1200° C.×1.5 hours under $1\times10^{-3}$ torr reduced pressure.

Next, after cooling the produced presintered compact to ambient temperature, a coating film was formed on the surface of each presintered compact in the same manner as in the above, and then the presintered compacts were set in the isostatic pressing machine described earlier and subjected to isostatic pressing (CIP). In this pressing process, conditions were 35° C. temperature, 8 t/cm$^2$ pressure.

Next, the presintered compacts after the pressing were sintered in a sintering furnace to effect main sintering (final sintering) in order to produce sintered compacts. Sintering conditions during the main sintering were 1350° C.×2 hours in an Ar gas atmosphere.

The coating film on each green body was eliminated in the course of the sintering treatment.

Example 14g

Sintered compacts were produced in the same manner as in Example 13g, except that conditions for isostatic pressing (CIP) were changed into 35° C. temperature under 30 t/cm$^2$ pressure.

Example 15g

Sintered compacts were produced in the same manner as in Example 13g, except that conditions for isostatic pressing (CIP) were changed into 35° C. temperature under 65 t/cm$^2$ pressure.

Example 16g

Sintered compacts were produced in the same manner as in Example 13g, except that sintering conditions during the main sintering were changed into 1350° C.×1.5 hours in an Ar gas atmosphere.

Example 17g

Sintered compacts were produced in the same manner as in Example 14g, except that sintering conditions during the main sintering were changed into 1300° C.×2 hours in an Ar gas atmosphere.

Example 18g

Sintered compacts were produced in the same manner as in Example 15g, except that sintering conditions during the main sintering were changed into 1300° C.×1.5 hours in an Ar gas atmosphere.

Comparative Example 3g

Sintered compacts were produced in the same manner as in Example 13g, except that isostatic pressing process for pressing the presintered compacts was omitted, and that sintering conditions during the main sintering treatment were changed into 1400° C.×2.5 hours in an Ar gas atmosphere. In this regard, the presintering and the main sintering were continuously conducted.

<QUALITY/PROPERTIES EVALUATION>

The sintered compacts obtained in each of Examples 1g–18g and in each of Comparative Examples 1g–3g were cut along ifferent cutting planes to observe visually the cutting planes thereof. In each observation, no sintering flaws and other flaws were found on the cutting plane of each sintered compact. Namely, through the observations, it was found that the sintered compacts obtained in each of Examples 1g–18g and in each of Comparative Examples 1g–3g had good quality.

Subsequently, each sintered compact was measured to determine relative density (which was represented from the equation "100-porosity" [%]) and tensile strength [N/mm$^2$]. Measurement results are given in the attached Tables 19 to 21.

As shown in each table, it has been found that the sintered compacts obtained in each of Examples 1g–18g can have higher density and improved mechanical strength under the sintering conditions of lower sintering temperatures and shorter sintering times as compared with the sintered compacts prepared in each of Comparative Examples 1g–3g of which presintered compacts were not pressurized.

Example 1h 200 sintered compacts were produced in the same manner as in Example 1g, except that a hole of 5.1 mmϕ diameter×10.2 mm deep (target dimensions after main sintering were 5 mmϕ diameter×10 mm depth) was formed in the center of each presintered compact after pressing.

Example 2h 200 sintered compacts were produced in the same manner as in Example 2g, except that a hole having the same dimensions as in Example 1h was formed in the center of of each presintered compact after pressing.

Example 3h 200 sintered compacts were produced in the same manner as in Example 3g, except that a hole having the same dimensions as in Example 1h was formed in the center of each presintered compact after pressing.

Example 4h 200 sintered compacts were produced in the same manner as in Example 4g, except that a hole having the same dimensions as in Example 1h was formed in the center of each presintered compact after pressing.

Example 5h 200 sintered compacts were produced in the same manner as in Example 5g, except that a hole having the same dimensions as in Example 1h was formed in the center of each presintered compact after pressing.

Example 6h 200 sintered compacts were produced in the same manner as in Example 6g, except that a hole having the same dimensions as in Example 1h was formed in the center of each presintered compact after pressing.

Comparative Example 1h 200 sintered compacts were produced in the same manner as in Comparative Example 1g, except that a hole of 5.15 mmϕ diameter×10.3 mm deep (target dimensions after main sintering were 5 mmϕ diameter×10 mm depth) was formed in the center of each presintered compact after pressing (which had not undergone pressing).

Example 7h 200 sintered compacts were produced in the same manner as in Example 7g, except that a hole of 5.1 mmϕ diameter× 10.2 mm deep (target dimensions after main sintering were 5 mmϕ diameter×10 mm depth) was formed in the center of each presintered compact after pressing.

Example 8h 200 sintered compacts were produced in the same manner as in Example 8g, except that a hole having the same dimensions as in Example 7h was formed in the center of each presintered compact after pressing.

Example 9h 200 sintered compacts were produced in the same manner as in Example 9g, except that a hole having the same dimensions as in Example 7h was formed in the center of each presintered compact after pressing.

Example 10h 200 sintered compacts were produced in the same manner as in Example 10g, except that a hole having the same dimensions as in Example 7h was formed in the center of each presintered compact after pressing.

Example 11h 200 sintered compacts were produced in the same manner as in Example 11g, except that a hole having the same dimensions as in Example 7h was formed in the center of each presintered compact after pressing.

Example 12h 200 sintered compacts were produced in the same manner as in Example 12g, except that a hole having the same dimensions as in Example 7h was formed in the center of each presintered compact after pressing.

Comparative Example 2h 200 sintered compacts were produced in the same manner as in Comparative Example 2g, except that a hole of 5.15 mmϕ diameter×10.3 mm deep (target dimensions after main sintering were 5 mmϕ diameter×10 mm depth) was formed in the center of each presintered compact.

Example 13h 200 sintered compacts were produced in the same manner as in Example 13g, except that a hole of 5.1 mmϕ diameter× 10.2 mm deep (target dimensions after main sintering were 5 mmϕ diameter×10 mm depth) was formed in the center of each presintered compact after pressing.

Example 14h 200 sintered compacts were produced in the same manner as in Example 14g, except that a hole having the same dimensions as in Example 13h was formed in the center of each presintered compact after pressing.

Example 15h 200 sintered compacts were produced in the same manner as in Example 15g, except that a hole having the same dimensions as in Example 13h was formed in the center of each presintered compact after pressing.

Example 16h 200 sintered compacts were produced in the same manner as in Example 16g, except that a hole having the same dimensions as in Example 13h was formed in the center of each presintered compact after pressing.

Example 17h 200 sintered compacts were produced in the same manner as in Example 17g, except that a hole having the same dimensions as in Example 13h was formed in the center of each presintered compact after pressing.

Example 18h 200 sintered compacts were produced in the same manner as in Example 18g, except that a hole having the same dimensions as in Example 13h was formed in the center of each presintered compact after pressing.

Comparative Example 3h 200 sintered compacts were produced in the same manner as in Comparative Example 3g, except that a hole of 5.15 mm diameter×10.3 mm deep (target dimensions after main sintering were 5 mmϕ diameter×10 mm depth) was formed in the center of each presintered compact.

<QUALITY/PROPERTIES EVALUATION>

The sintered compacts obtained in each of Examples 1h–18h and in each of Comparative Examples 1h–3h were cut along different cutting planes to observe visually the cutting planes thereof. In each observation, no sintering flaws and other flaws were found on the cutting plane of each sintered compact. Namely, through the observations, it was found that the sintered compacts obtained in each of Examples 1h–18h and in each of Comparative Examples 1h–3h had good quality.

Subsequently, each sintered compact was measured to determine relative density (which was represented from the equation "100-porosity" [%]) and tensile strength [N/mm$^2$]. Measurement results are given in the attached Tables 22 to 24.

Further, dimensional error in diameter and height of each sintered compact (that is, error with respect to target dimensions: which is represented as average value for 200 compacts); and dimensional error in diameter and depth of the hole formed in each sintered compact (that is, error with respect to target dimensions: which is represented as average value for 200 sintered compacts) were measured. Measurement results are presented in the attached Tables 22 to 24.

As shown in each table, it has been found that the sintered compacts obtained in each of Examples 1h–18h can have higher density and improved mechanical strength under the sintering conditions of lower sintering temperatures and shorter sintering times as compared with the sintered compacts prepared in each of Comparative Examples 1h–3h of which presintered compacts were not pressurized.

Further, it has been also found that the sintered compacts prepared in each of Examples 1h–18h exhibit less dimensional error in the overall and in the hole and have high dimensional precision as compared with the sintered compacts prepared in each of Comparative Examples 1h–3h of which presintered compacts were not pressurized.

According to the invention described above, it is possible to obtain sintered compacts having improved sinterability and higher quality. In particular, it is possible to obtain sintered compacts having higher density and improved mechanical strength.

Further, according to the present invention, sintering conditions can be moderated, in particular, lower sintering temperatures or shorter sintering times can be used, while still maintaining high quality, thereby facilitating to manufacture sintered compacts and reducing the load applied to the sintering furnace and sintering jig.

In particular, when pressing for the green body is carried out during the debinding treatment, it is possible to effectively prevent flaws from being formed on the green body during the pressing.

Further, when conducting the pressing after the presintering process, it is possible to effectively prevent flaws from being formed on the presintered compact during the pressing.

Furthermore, according to the present invention, it is possible to stabilize shapes and dimension of the sintered compacts and increase dimensional precision. In particular, excellent workability can be achieved during machine working processes, and machining for hard metals and complex shapes which were not readily accomplished with conventional machining process can be made easily. In addition, machined areas have high dimensional precision.

INDUSTRIAL UTILIZATION

The method of manufacturing sintered compacts according to the present invention is suitable for manufacturing of various metal products such as exterior components of watches, accessories and other precious metal products, eyeglass frames, various machine components, tools, weights, golf club heads and other sports products, weapons, coins, medallions, and the like. The method is particularly suitable for manufacturing of products having complex shape and products which are required to have high dimensional precision.

What is claimed is:

1. A method of manufacturing a sintered compact, comprising the steps of:

producing a green body containing metal powder;

debinding the green body at least once;

presintering the debinded green body;

compacting the presintered green body by pressing it, wherein the pressing for compaction is carried out isotropically; and sintering the compacted presintered green body further to obtain a sintered compact.

2. The method of manufacturing a sintered compact as claimed in claim 1, further comprising a step of performing machine working on the compacted presintered green body between the presintered green body compacting step and the presintered green body sintering step.

3. The method of manufacturing a sintered compact as claimed in claim 1 or 2, wherein the green body presintering step is being carried out until diffusion bonding is made at least at contact points of particles of the metal powder.

4. The method of manufacturing a sintered compact as claimed in claim 1, wherein the pressing for compacting is carried out by means of an isostatic pressing.

5. The method of manufacturing a sintered compact as claimed in claim 4, wherein the isostatic pressing is carried out at ambient temperature or temperature close thereto.

6. The method of manufacturing a sintered compact as claimed in claim 1, wherein pressure during the pressing is 1 to 100 t/cm$^2$.

7. The method of manufacturing a sintered compact as claimed in claim 1, wherein the green body producing step is carried out by means of metal injection molding.

8. The method of manufacturing a sintered compact as claimed in claim 1, wherein the metal powder content of the green body just before the debinding treatment is 70 to 98 wt %.

9. The method of manufacturing a sintered compact as claimed in claim 1, wherein the metal powder for the green body is prepared in accordance with a gas atomization method.

* * * * *